United States Patent [19]

Kato et al.

[11] Patent Number: 4,954,407

[45] Date of Patent: Sep. 4, 1990

[54] ELECTROPHOTOGRAPHIC PHOTORECEPTOR COMPRISING BINDER RESIN CONTAINING ACIDIC GROUPS

[75] Inventors: Eiichi Kato; Kazuo Ishii, both of Shizuoka, Japan

[73] Assignee: Fuji Photo Film Co., Ltd., Kanagawa, Japan

[21] Appl. No.: 414,334

[22] Filed: Sep. 29, 1989

[30] Foreign Application Priority Data

| | | | |
|---|---|---|---|
| Sep. 30, 1988 | [JP] | Japan | 63-244417 |
| Nov. 8, 1988 | [JP] | Japan | 63-280391 |
| Nov. 17, 1988 | [JP] | Japan | 63-288971 |

[51] Int. Cl.[5] ..... G03G 5/087

[52] U.S. Cl. ..... 430/96; 430/49; 430/58; 430/910

[58] Field of Search ..... 430/96, 49

[56] References Cited

U.S. PATENT DOCUMENTS 4,551,403 11/1985 Miyakawa ..... 430/96

*Primary Examiner*—J. David Welsh

*Attorney, Agent, or Firm*—Sughrue, Mion, Zinn, Macpeak & Seas

[57] ABSTRACT

An electrophotographic photoreceptor comprising a support having thereon at least one photoconductive layer containing at least inorganic photoconductive particles and a binder resin, wherein said binder resin has a weight average molecular weight of from $1\times10^3$ to $5\times10^4$ and comprises (A) at least one resin comprising, as a polymerization component, (a-i) not less than 30% by weight of at least one repeating unit represented by formula (I) or (II):

(I)

(II)

wherein $X_1$ and $X_2$, which may be the same or different, each represents a hydrogen atom, a hydrocarbon group having from 1 to 10 carbon atoms, a chlorine atom, a bromine atom, —$COY_1$ or —$COOY_2$, wherein $Y_1$ and $Y_2$ each represents a hydrocarbon group having from 1 to 10 carbon atoms, provided that both $X_1$ and $X_2$ do not simultaneously represent a hydrogen atom; and $W_1$ and $W_2$ each represents a bond or a linking group containing from 1 to 4 linking atoms which connects —COO— and the benzene ring, with at least one acidic group selected from the group consisting of (i) —$PO_3H_2$, (ii) —$SO_3H$, (iii) —COOH, wherein R represents a hydrocarbon group having from 1 to 10 carbon atoms or —OR', wherein R' represents a hydrocarbon group having from 1 to 10 carbon atoms, and (v) a cyclic acid anhydride-containing group, being bonded to only one of the terminals of the polymer main chain thereof. The photoreceptor exhibits excellent electrostatic characateristics, image formation performance as well as printing suitability irrespective of variations in environmental conditions or the kind of sensitizing dyes used in combination with the photoreceptor.

11 Claims, No Drawings

ELECTROPHOTOGRAPHIC PHOTORECEPTOR COMPRISING BINDER RESIN CONTAINING ACIDIC GROUPS

FIELD OF THE INVENTION

This invention relates to an electrophotographic photoreceptor, and more particularly to an electrophotographic photoreceptor having excellent electrostatic characteristics and moisture resistance, and, especially, performance properties as a CPC photoreceptor.

BACKGROUND OF THE INVENTION

An electrophotographic photoreceptor may have various structures depending on the characteristics required or electrophotographic processes to be employed.

A system in which a photoreceptor comprises a support having thereon at least one photoconductive layer and, if necessary, an insulating layer on the surface thereof is widely employed. The photoreceptor comprising a support and at least one photoconductive layer is subjected to ordinary electrophotographic processing for image formation including charging, imagewise exposure, development and, if desired, transfer.

Electrophotographic photoreceptors have also been used widely as offset printing plate precursor for direct printing plate making. In particular, a direct electrophotographic lithographic printing system has recently been acquiring a greater importance as a system providing hundreds to thousands of prints of high image quality.

Binders which are used in the photoconductive layer should themselves have film-forming properties and the capability of dispersing photoconductive particles therein. Also, when formulated into a photoconductive layer, the binders should have satisfactory adhesion to a support. They also must have various electrostatic characteristics and image-forming properties, such that the photoconductive layer exhibits excellent electrostatic capacity, small dark decay and large light decay, hardly undergo fatigue before exposure, and maintain these characteristics in a stable manner against change of humidity at the time of image formation.

Binder resins which have been conventionally used include silicone resins (see JP-B-34-6670, the term "JP-B" as used herein means an "examined published Japanese patent application"), styrene-butadiene resins (see JP-B-35-1960), alkyd resins, maleic acid resins and polyamides (see Japanese JP-B-35-11219), vinyl acetate resins (see JP-B-41-2425), vinyl acetate copolymer resins (see JP-B-41-2426), acrylic resins (see JP-B-35-11216), acrylic ester copolymer resins (see JP-B-35-12129, JP-B-36-81510, and JP-B-41-13946), etc. However, electrophotographic photosensitive materials using these known resins have a number of disadvantages, i.e., poor affinity for photoconductive particles (poor dispersion of a photoconductive coating composition); low photoconductive layer charging properties; poor reproduced image quality, particularly dot reproducibility or resolving power; susceptibility of the reproduced image quality to influences from the environment at the time of electrophotographic image formation, such as high temperature and high humidity conditions or low temperature and low humidity conditions; and the like.

To improve the electrostatic characteristics of a photoconductive layer, various approaches have hitherto been taken. For example, incorporation of a compound containing an aromatic ring or furan ring containing a carboxyl group or a nitro group either alone or in combination with a dicarboxylic acid anhydride into a photoconductive layer as disclosed in JP-B-42-6878 and JP-B-45-3073 has been proposed. However, the thus improved photosensitive materials still have insufficient electrostatic characteristics, particularly light decay characteristics. The insufficient sensitivity of these photosensitive materials has been compensated for by incorporation a large quantity of a sensitizing dye into the photoconductive layer. However, photosensitive materials containing a large quantity of a sensitizing dye undergo considerable whiteness deterioration, which means reduced quality as a recording medium, sometimes causing a deterioration in dark decay characteristics, resulting in a failure to obtain a satisfactory reproduced image.

On the other hand, JP-A-60-10254 (the term "JP-A" as used herein means an "unexamined published Japanese patent application") suggests control of the average molecular weight of a resin to be used as a binder of the photoconductive layer. According to this suggestion, the combined use of an acrylic resin having an acid value of from 4 to 50 whose average molecular weight is distributed within two ranges, i.e., a range of from $1\times10^3$ to $1\times10^4$ and a range of from $1\times10^4$ and $2\times10^5$, would improve the electrostatic characteristics, particularly reproducibility, as a PPC photoreceptor on repeated use, moisture resistance and the like.

In the field of lithographic printing plate precursors, extensive studies have been conducted to provide binder resins for a photoconductive layer having electrostatic characteristics compatible with printing characteristics. Examples of binder resins so far reported to be effective for oil-desensitization of a photoconductive layer include a resin having a molecular weight of from $1.8\times10^4$ to $10\times10^4$ and a glass transition point of from 10° C. to 80° C. obtained by copolymerizing a (meth)acrylate monomer and a copolymerizable monomer in the presence of fumaric acid in combination with a copolymer of a (meth)acrylate monomer and a copolymerizable monomer other than fumaric acid as disclosed in JP-B-50-31011; a terpolymer containing a (meth)acrylic ester unit with a substituent having a carboxyl group at least 7 atoms distant from the ester linkage as disclosed in JP-A-53-54027; a tetra- or pentapolymer containing an acrylic acid unit and a hydroxyethyl (meth)acrylate unit as disclosed in JP-A-54-20735 and JP-A-57-202544; a terpolymer containing a (meth)acrylic ester unit with an alkyl group having from 6 to 12 carbon atoms as a substituent and a vinyl monomer containing a carboxyl group as disclosed in JP-A-58-68046; and the like.

However, none of these resins proposed has proved to be satisfactory for practical use in charging properties, dark charge retention, photosensitivity, and surface smoothness of the photoconductive layer.

The binder resins proposed for use in electrophotographic lithographic printing plate precursors were also proved by actual evaluations to give rise to problems relating to electrostatic characteristics, background staining of prints, and moisture resistance.

Electrophotographic recording systems utilizing a laser beam as a light source have recently been developed. In this system, laser light emitted from a laser and condensed through an $f\theta$ lens is reflected on a polygon mirror to form a scan image on a photoreceptor, and the image is then developed and, if necessary, transferred.

With the recent development of semi-conductor lasers of low output, e.g., of from about 4 mW to 25 mW, development of a photosensitive material having a sensitivity in the wavelength region of 700 nm or more is required. An electrophotographic photoreceptor applicable to processing using such a low output laser must possess special characteristics different form those required for conventional electrophotographic photoreceptors. Particularly important is the property that the photoreceptor should exhibit sufficient sensitivity to the near infrared to infrared light as well satisfactory dark charge retention.

The combination of a photoconductive substance-binder resin dispersed system with various kinds of near infrared to infrared spectral sensitizing dyes to form an electrophotographic photoreceptor as disclosed, e.g., in JP-A-58-58554, JP-A-58-42055, JP-A-58-59453, and JP-A-57-46245 is known. These photoreceptors, however, have turned out to have insufficient dark charge retention and photosensitivity. As stated above, in using a laser, e.g., a semi-conductor laser, as a light source, exposure of a photoconductive layer is effected by scanning so that the time form charging through the end of exposure becomes longer than that required in the conventional exposure to visible light over the entire surface thereof. The charge on the unexposed area should be sufficiently retained over that time. Thus, dark charge retention is one of the extremely important characteristics required for electrophotographic photoreceptors to be used in scanning exposure. The above-described conventional photoreceptors have been unsatisfactory in this point.

Taking the low output of the light source into consideration, sufficiently high sensitivity in the near infrared to infrared region is an important characteristic as well. Conventional photoreceptors are also unsatisfactory in this respect.

SUMMARY OF THE INVENTION

An object of this invention is to provide an electrophotographic photoreceptor having improved electrostatic characteristics, particularly dark charge retention and photosensitivity, and improved image reproducibility.

Another object of this invention is to provide an electrophotographic photoreceptor which forms a clear reproduced image of high quality unaffected by variations in environmental conditions at the time of reproduction of an image, such as a change to low-temperature and low-humidity conditions or to high-temperature and high-humidity conditions.

A further object of this invention is to provide a CPC electrophotographic photoreceptor having excellent electrostatic characteristics and small change due to environmental changes.

An even further object of this invention is to provide an electrophotographic photoreceptor which forms a clear reproduced image of high quality even when processed by a scanning exposure system utilizing a semiconductor laser beam.

A still further object of this invention is to provide a lithographic printing plate precursor which provides a lithographic printing plate where background stains do not occur.

Yet a further object of this invention is to provide an electrophotographic photoreceptor which is hardly influenced by the kind of sensitizing dyes used in combination.

It has now been found that the above objects of this invention are accomplished by an electrophotographic photoreceptor comprising a support having thereon at least one photoconductive layer containing at least inorganic photoconductive particles and a binder resin, wherein the binder resin has a weight average molecular weight of from $1\times10^3$ to $5\times10^4$ and comprises (A) at least one resin comprising, as a polymerization component, (a-i) not less than 30% by weight of at least one repeating unit represented by formula (I) or (II):

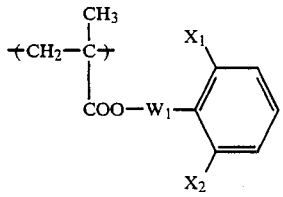

(I)

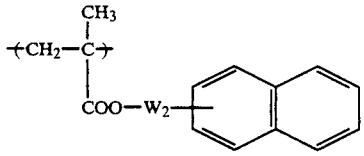

(II)

wherein $X_1$ and $X_2$, which may be the same or different, each represents a hydrogen atom, a hydrocarbon group having from 1 to 10 carbon atoms, a chlorine atom, a bromine atom, $—COY_1$ or $—COOY_2$, wherein $Y_1$ and $Y_2$, each represents a hydrocarbon group having from 1 to 10 carbon atoms, provided that both $X_1$ and $X_2$ do not simultaneously represent a hydrogen atom; and $W_1$ and $W_2$ each represents a bond or a liking group containing from 1 to 4 linking atoms which connects —COO— and the benzene ring, with at least one acidic group selected from the group consisting of (i) $—PO_3H_2$, (ii) $—SO_3H$, (iii) —COOH,

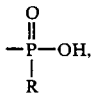

(iv)

wherein R represents a hydrocarbon group having from 1 to 10 carbon atoms or —OR', wherein R' represents a hydrocarbon group having from 1 to 10 carbon atoms, and (v) a cyclic acid anhydride-containing group, being bonded to only one of the terminals of the polymer main chain thereof.

The term "a hydrocarbon group" used herein means an allyl group, an alkenyl group, an aralkyl group or an aryl group.

It has also been found that film strength of a photoconductive layer can further be improved to provide an electrophotographic photoreceptor exhibiting excellent printing durability by using the above-stated resin (A) which further comprises (a-ii) form 1 to 20% by weight of at least one repeating unit containing a heat- and/or light-curing functional group.

It has furthermore been found that improvement of film strength can be enhanced by using, as a binder resin, (B) at least one resin having a weight average molecular weight of form $2\times10^4$ to $6\times10^5$ in combination with the resin (A).

In a preferred embodiment, the resin (B) comprises (b-i) at least 30% by weight of a repeating unit represented by formula (III):

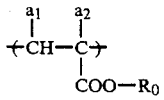

(III)

wherein $a_1$ and $a_2$, which may be the same or different, each represents a hydrogen atom, a halogen atom, a cyano group or a hydrocarbon group; and $R_0$ represents a hydrocarbon group.

The resin (B) more preferably contains, in addition to the repeating unit (b-i), from 0.05 to 5% by weight of a copolymerization component containing the acidic group (a-i) as described above and a weight average molecular weight of from $2\times10^4$ to $1\times10^5$.

In another preferred embodiment, the resin (B) contains from 1 to 30% by weight of at least one repeating unit containing a heat- and/or light-curing functional group.

The electrophotographic photoreceptor of the present invention preferably contains a heat- and/or light-curing crosslinking agent in combination with the binder resin.

DETAILED DESCRIPTION OF THE INVENTION

The resin (A) which can be used in the present invention as a binder has a weight average molecular weight of from $1\times10^3$ to $2\times10^4$, preferably form $3\times10^3$ to $1\times10^4$. The resin (A) contains not less than 30% by weight, more preferably form 50 to 97% by weight, of copolymerization component (a-i) corresponding to the repeating unit represented by formula (I) or (II). The proportion of the copolymerization component containing the above-specified acidic group in the resin (A) is from 0.5 to 15% by weight, more preferably form 3 to 10% by weight. The proportion of copolymerization component (a-ii) containing a heat- and/or light-curing functional group, if present, is from 1 to 30% by weight. The resin (A) preferably has a glass transition point (Tg) of from −10° to 100° C., more preferably form −5° to 80° C.

If the molecular weight of the resin (A) is less than $1\times10^3$, the film-forming properties of the binder are reduced, and sufficient film strength is not retained.

On the other hand, if it exceeds $2\times10^4$, the electrophotographic characteristics, and particularly initial potential and dark decay retention, are degraded. Deterioration of electrophotographic characteristics is particularly conspicuous in using such a high-molecular weight polymer having an acidic group-containing copolymerization component content exceeding 3%, resulting in considerable background staining when used as an offset master.

If the acidic group-containing copolymerization component content in the resin (A) is less than 0.5% by weight, the initial potential is too low for a sufficient image density to be obtained. If it exceeds 15% by weight, dispersibility is reduced, film smoothness and humidity resistance are reduced and background stains are increased when the photoreceptor is used as an offset master.

When resin (A) contains a heat- and/or light-curing functional group, if the content of this copolymerization component is less than 1% by weight, improvement in film strength of a photoconductive layer is not produced due to insufficient curing reaction. On the other hand, more than 30% by weight of this component impairs the excellent electrophotographic characteristics brought about by resin (A), only resulting in the characteristics obtained by using the conventionally known binder resins. In addition, an offset master plate produced from the resulting photoreceptor has considerable background stains in the prints.

Resin (B) which can be used in the present invention suitably has a weight average molecular weight of from $2\times10^4$ to $6\times10^5$. When resin (B) does not contain, as polymerization component, a component containing the specific acidic group as is present in resin (A) or a component containing a heat- and/or light-curing functional group (i.e., a-ii), a preferred weight average molecular weight of this resin (B) is from $8\times10^4$ to $6\times10^5$. When it contains the specific acidic group-containing component and/or the heat- and/or light-curing functional group-containing component, a preferred weight average molecular weight of this resin (B) is from $2\times10^4$ to $1\times10^5$.

If the weight average molecular weight of resin (B) containing neither the acidic group-containing component nor the curing functional group-containing components less than $8\times10^4$, the effect of improving film strength becomes insufficient, and the printing durability of an offset master plate produced is insufficient form obtaining more than 10000 prints. If it exceeds $6\times10^5$, on the other hand, resin (B) has reduced solubility in organic solvents and, as a result, a uniform dispersion of a photoconductive substance can hardly be obtained, and this leads to reduced film strength.

If the weight average molecular weight of resin (B) containing an acidic group-containing component and/or a curing functional group-containing component is less than $2\times10^4$, sufficient film strength for use as an offset master plate precursor is not obtained. If it exceeds $1\times10^5$, the dispersion tends to form agglomerates or the resulting photoconductive layer tends to become brittle since the film hardness is too high, ultimately resulting in reduced film strength. Moreover, the electrophotographic characteristics of the resulting photoreceptor are considerably reduced, particularly in dark decay retention and photosensitivity.

If desired, a crosslinking agent may be used in combination with the binder resin. The crosslinking agent is preferably used in an amount of form 1 to 30% by weight, more preferably from 5 to 20% by weight, based on the weight of the total binder resin. Use of less than 1% by weight of the crosslinking agent produces no effect in improving film strength. Use of more than 30% by weight of the crosslinking agent results in a deterioration of the electrophotographic characteristics, such as initial potential, dark decay retention, photosensitivity, and residual potential. Further, an offset master plate produced using such a large amount of a crosslinking agent has remarkable background stains.

As described above, conventionally known acidic group-containing binder resins have been proposed chiefly for use in an offset master plate and, hence, they have a large molecular weight, e.g., more than $5\times10^4$, in order to retain film strength and thereby improved printing durability.

To the contrary, in the acidic group-containing resin (A) having a methacrylate copolymerization component with a specific substituent, it has been confirmed that the methacrylate component containing a planar benzene ring or naphthalene ring and the acidic group are adsorbed properly onto stoichiometrical defects of an inorganic photoconductive substance on the surface thereof is covered sufficiently. Thus, electron traps of the photoconductive substance can be compensated for and humidity resistance can be greatly improved, while aiding sufficient dispersion of the photoconductive particles without agglomeration. The fact that resin (A) has a low molecular weight also improves the covering power for the surface of the photoconductive particles.

The photoconductive layer obtained by the present invention has improved surface smoothness. If a photoreceptor to be used as a lithographic printing plate precursor is prepared form a non-uniform dispersion of photoconductive particles in a binder resin with agglomerates being present, the photoconductive layer has a rough surface. As a result, non-image areas cannot be rendered uniformly hydrophilic by oil-desensitization treatment with an oil-desensitizing solution. This being the case, the resulting printing plate induces adhesion of a printing ink to the non-image areas on printing, which phenomenon leads to background stains in the non-image areas of prints.

Thus, low-molecular weight resin (A) of the present invention is sufficiently adsorbed onto the photoconductive particles to cover the surface of the particles to thereby provide photoconductive layer smoothness, satisfactory electrostatic characteristics, and stain-free images. The film strength of the resulting photoreceptor suffices for use as a CPC photoreceptor or as an offset printing plate precursor for production of an offset printing plate to be used for obtaining around a thousand prints under limited printing conditions, such as printing by means of a desk-top (small-sized) printer.

In addition, it was proved that mechanical strength of the photoconductive layer can be further improved by various embodiments of this invention. That is, improvement in film strength can be achieved by (1) an embodiment in which resin (A) further contains a curing functional group and/or a curing function group-containing resin (A) is combined with resin (B) containing a curing functional group and/or a crosslinking agent to thereby induce crosslinking between resin (A) and/or between resins (A) and (B); (2) an embodiment in which resin (A) which does not contain any curing functional group is combined with high-molecular resin (B) whereby the advantage of the entanglement of the long high-molecular weight chains of the resin (B) per se is used; (3) an embodiment in which resin (A) is combined with resin (B) containing a small proportion of a specific acidic group thereby to cause resin (B) to exert a weak mutual action on the inorganic photoconductive particles; (4) an embodiment in which resin (A) is combined with reins (B) containing a curing functional group and a crosslinking agent to induce a crosslinking reaction among the molecules of resin (B); and (5) an embodiment in which resin (A) is combined with resin (B) containing both an acidic group-containing component and a curing functional group-containing component to thereby produce the above-described two effects.

Improved mechanical strength of the photoconductive layer as obtained in these preferred embodiments leads to not only improved performance properties for use as a CPC photoreceptor, such as abrasion resistance, writability, and filing properties (strength can be retained on filing) but also improved performance properties for use as an offset master plate precursor, such as a printing durability amounting to 6000 to 10000 prints irrespective of variations of printing conditions (e.g., use of a large-sized printing machine or an increased printing pressure). In other words, these preferred embodiments provide improvement in mechanical strength of the photoconductive layer which might be insufficient in using resin (A) alone depending on the end use, without impairing the function of resin (A) at all.

The electrophotographic photoreceptor according to the present invention thus has excellent electrostatic characteristics irrespective of variations in environmental conditions as well as sufficient film strength, thereby making it possible to provide an offset master plate having a printing durability of more than 10000 prints. Further, these excellent electrostatic characteristics can be achieved in a stable manner irrespective of the environmental conditions even when processed according to a scanning exposure system utilizing a semi-conductor laser beam.

Repeating unit (a-i) which constitutes at least 30% by weight of the resin (A) can be represented by formula (I) or (II).

In formula (I), $X_1$ and $X_2$ each preferably represents a hydrogen atom, a chlorine atom, a bromine atom, an alkyl group having up to 4 carbon atoms (e.g., methyl, ethyl, propyl, and butyl), an aralkyl group having from 7 to 9 carbon atoms (e.g., benzyl, phenethyl, 3-phenylpropyl, chlorobenzyl, dichlorobenzyl, bromobenzyl, methylbenzyl, methoxybenzyl, and chloromethylbenzyl), an aryl group (e.g., phenyl, tolyl, xylyl, bromophenyl, methoxyphenyl, chlorophenyl, and dichlorophenyl), or $—COY_1$ or $—COOY_2$, wherein $Y_1$ and $Y_2$ each preferably represents any of the above-recited hydrocarbon groups, provided that $X_1$ and $X_2$ do not simultaneously represent a hydrogen atom.

In formula (I), $W_1$ is a bond or a linking group containing 1 to 4 linking atoms which connects —COO— and the benzene ring e.g., $-(CH_2)_2$ (n: 1,2 or 3), $—CH_2CH_2OCO—$, $—CH_2—_m$ (m: 1 or 2), and $-(CH_2CH_2O)-$.

In formula (II), W2 has the same meaning as $W_1$.

The proportion of the polymerization or copolymerization component corresponding to repeating unit (a-i) in resin (A) is from 30 to 100% by weight, preferably from 60 to 100% by weight.

Specific examples of repeating units (a-i) represented by formula (I) or (II) are shown below for illustrative purposes but this invention is not to be construed as being limited thereto.

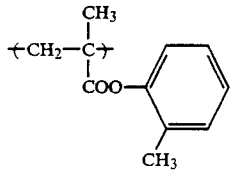
(i-1)

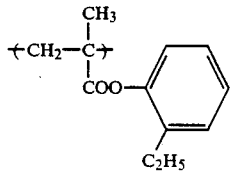
(i-2)

-continued
(i-3)
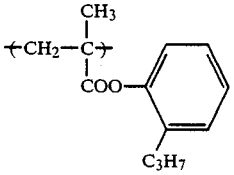
(i-4)
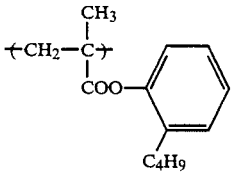
(i-5)
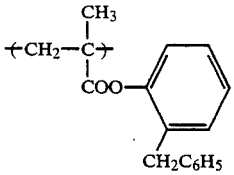
(i-6)
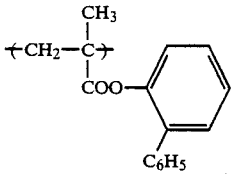
(i-7)
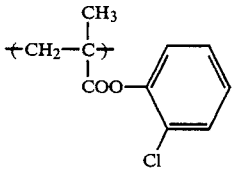
(i-8)
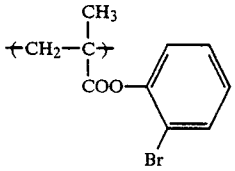
(i-9)
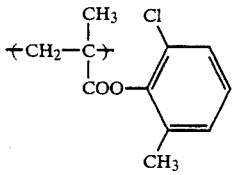
(i-10)
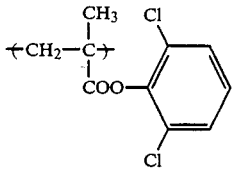
(i-11)
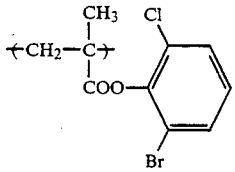
-continued
(i-12)
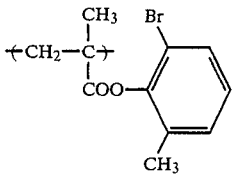
(i-13)
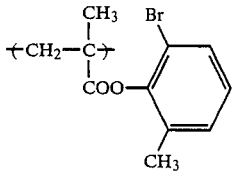
(i-14)
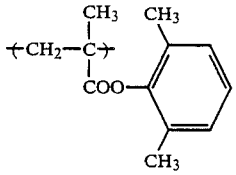
(i-15)
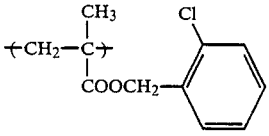
(i-16)
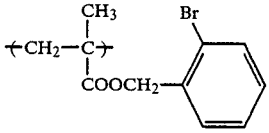
(i-17)
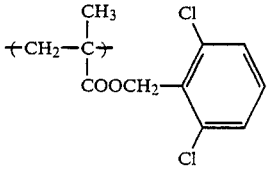
(i-18)
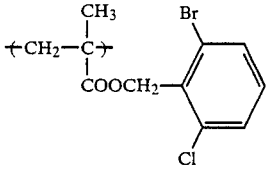
(i-19)
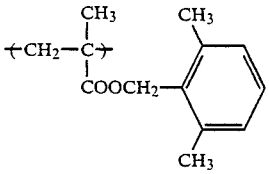
(i-20)
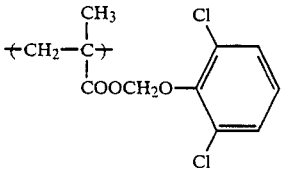

-continued
(i-21)
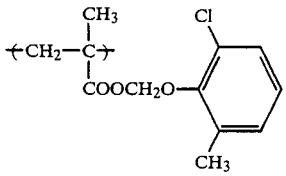
(i-22)
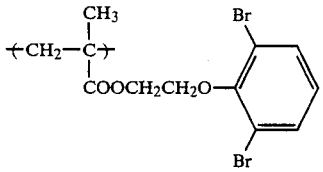
(i-23)
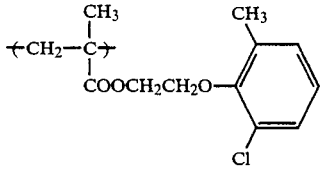
(i-24)
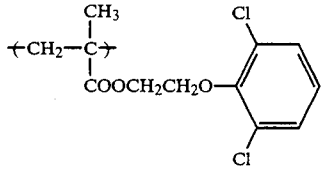
(i-25)
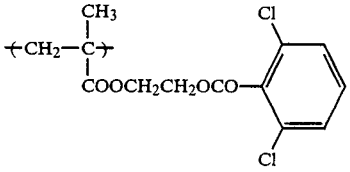
(i-26)
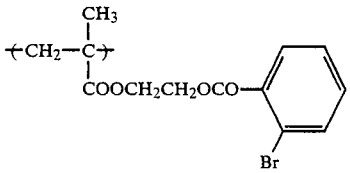
(i-27)
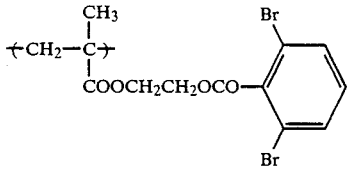
(i-28)
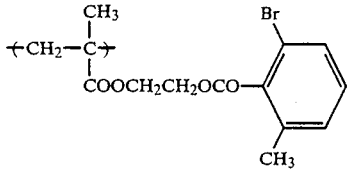
(i-29)
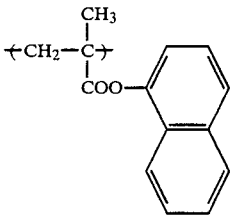
-continued
(i-30)
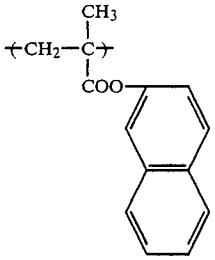
(i-31)
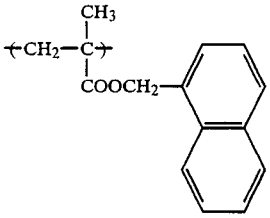
(i-32)
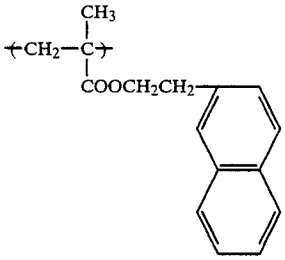
(i-33)
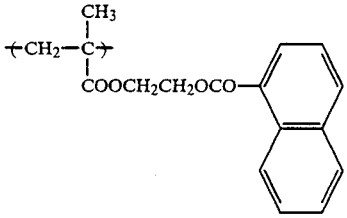
(i-34)
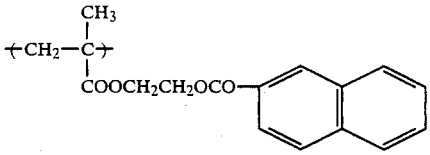
(i-35)
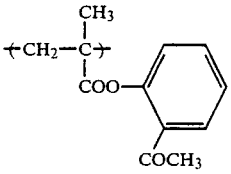
(i-36)
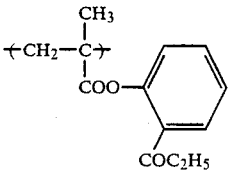

-continued (i-37)

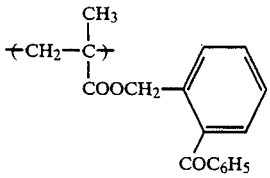

(i-38)

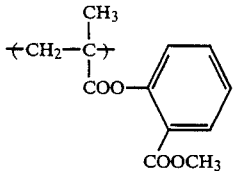

(i-39)

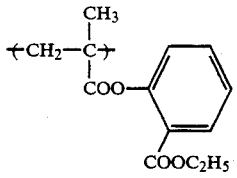

(i-40)

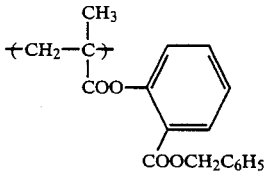

(i-41)

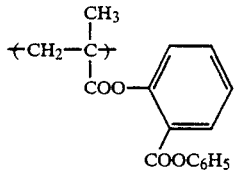

(i-42)

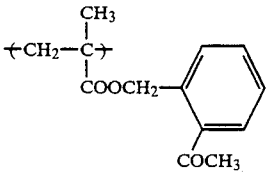

(i-43)

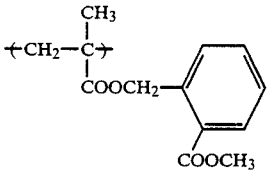

(i-44)

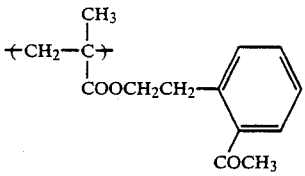

(i-45)

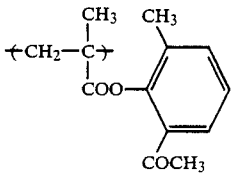

-continued (i-46)

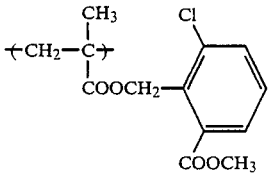

(i-47)

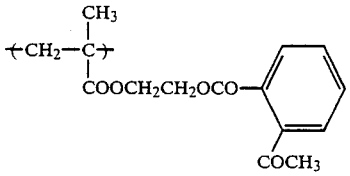

(i-48)

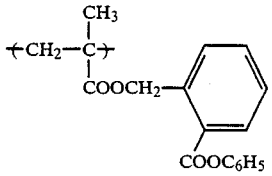

The acidic group bonded to one of the polymer main chain terminals in resin (A) includes —$PO_3H_2$—$SO_3H$,

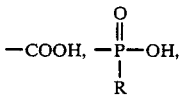

or a cyclic acid anhydride-containing group.

In the group

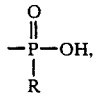

R represents a hydrocarbon group or —OR′, wherein R′ represents a hydrocarbon group. The hydrocarbon group as represented by R or R′ preferably includes an aliphatic group having from 1 to 10 carbon atoms (e.g., methyl, ethyl, propyl, butyl, hexyl, octyl, decyl, dodecyl, octadecyl, 2-chloroethyl, 2-methoxyethyl, 3-ethoxypropyl, allyl, crotonyl, butenyl, cyclohexyl, benzyl, phenethyl, 3-phenylpropyl, methylbenzyl, chlorobenzyl, fluorobenzyl, and methoxybenzyl) and a substituted or unsubstituted aryl group (e.g., phenyl, tolyl, ethylphenyl, propylphenyl, chlorophenyl, fluorophenyl, bromophenyl, chloromethylphenyl, dichlorophenyl, methoxyphenyl, cyanophenyl, acetamindophenyl, acetylphenyl, and butoxyphenyl).

The cyclic acid anhydride-containing group is a group containing at least one cyclic acid anhydride moiety. The cyclic acid anhydride which is present includes aliphatic dicarboxylic acid anhydrides and aromatic dicarboxylic acid anhydrides.

Specific examples of aliphatic dicarboxylic acid anhydrides rings include a succinic anhydride ring, a glutaconic anhydride ring, a maleic anhydride ring, a cyclopentane-1,2-dicarboxylic acid anhydride ring, a cyclohexane-1,2-dicarboxylic acid anhydride ring, a cyclohexene-1,2-dicarboxylic acid anhydride ring, and a 2,3-bicyclo[2,2,2]octanedicarboxylic acid anhydride ring. These rings may be substituted with, for example, a halogen atom (e.g., chlorine and bromine) and an alkyl group (e.g., methyl, ethyl, butyl, and hexyl).

Specific examples of aromatic dicarboxylic acid anhydride rings are a phthalic anhydride ring, a naphthalene-dicarboxylic acid anhydride ring, a pyridinedicarboxylic acid anhydride ring, and a thiophenedicarboxylic acid anhydride ring. These rings may be substituted with, for example, a halogen atom (e.g., chlorine and bromine), an alkyl group (e.g., methyl, ethyl, propyl, and butyl), a hydroxyl group, a cyano group, a nitro group, and an alkoxycarbonyl group (e.g., methoxycarbonyl and ethoxycarbonyl).

Resin (A) can be synthesized in such a manner that the specific acidic group may be bonded to one terminal of the main chain of the polymer comprising at least polymerization component (a-i). In greater detail, resin (A) can be prepared by a method using a polymerization initiator containing the specific acidic group or a functional group capable of being converted to the acidic group, a method using a chain transfer agent containing the specific acidic group or a functional group capable of being converted to the acidic group, a method using both of the polymerization initiator and chain transfer agent, and a method using the aforesaid functional group by taking advantage of reaction cease in anion polymerization. Reference can be made to e.g., P. Dreyfuss and R. P. Quirk, *Encyclo. Polym. Sci. Eng.*, No. 7, p. 551 (1987), V. Percec, *Appl. Polym. Sci.*, Vol. 285, p. 95 (1985), P. F. Rempp, and E. Franta, *Adv. Polym. Sci.*, Vol. 58, p. 1 (1984), Y. Yamashita, *J. Appl. Polym. Sci. Appl. Polym. Symp.*, Vol. 36, p. 193 (1981), and R. Asami and M. Takaki, *Macromol. Chem. Suppl.*, Vol. 12, p. 163 (1985).

In repeating unit (a-ii), which preferably constitutes resin (A), the term "heat- and/or light-curing functional group" means a functional group capable of inducing a resin curing reaction on application of heat and/or light.

The proportion of the copolymerization component containing the heat- and/or light-curing functional group in resin (A) is up to 20% by weight, preferably from 1 to 20% by weight. When it is less than 1% by weight, any appreciable effect in improving film strength is not produced because of the curing reaction is insufficient. When it is more than 20% by weight, the film becomes so hard that the electrophotographic characteristics are reduced and the offset master produced therefrom suffers from increased staining.

Specific examples of light-curing functional groups are those used in conventional photosensitive resins known as photocurable resins as described in Hideo Inui and Gentaro Nagamatsu, *Kankosei Kobunshi*, Kodansha (1977), Takahiro Tsunoda, *Shin-kankosei Jushi*, Insatsu Gakkai Shuppanbu (1981), G. E. Green and B. P. Starch, *J. Macro. Sci. Reas. Macro. Chem.*, C .21(2), pp. 187–273 (1981–1982), and C. G. Rattey, *Photopolymerization of Surface Coatings*, A. Wiley Interscience Pub. (1982).

The heat-curing functional group includes functional groups excluding the above-specified acidic groups. Examples of heat-curing functional groups are described in, e.g., Tsuyoshi Endo, *Netsukokasei Kobunshi no Seimitsuka*, C.M.C. (19867), Yuji Harasaki, *Saishin Binder Gijutsu Binran*, Ch. II-I, Sogo Gijutsu Center (1985), Takayuki Ohtsu, *Acryl Jushi no Gosei Sekkei to Shin-yoto*, Chubu Kei-ei Kaihatsu Center Shuppanbu (1985), and Eizo Ohmori, *Kinosei Acryl Jushi*, Techno System (1985).

Specific examples of curing functional groups are —OH, —SH, —$NH_2$, —$NHR_{11}$ (wherein $R_{11}$ represents a hydrocarbon group, such as a substituted or unsubstituted alkyl group (e.g., methyl, ethyl, propyl, butyl, hexyl, octyl, decyl, 2-chloroethyl, 2-methoxyethyl, and 2-cyanoethyl), a substituted or unsubstituted cycloalkyl group having from 4 to 8 carbon atoms (e.g., cycloheptyl and cyclohexyl), a substituted or unsubstituted aralkyl group having from 7 to 12 carbon atoms (e.g., benzyl, phenethyl, 3-phenylpropyl chlorobenzyl, methylbenzyl, and methoxybenzyl), and a substituted or unsubstituted aryl group (e.g., phenyl, tolyl, xylyl, chlorophenyl, bromophenyl, methoxybenzyl, and naphthyl)),

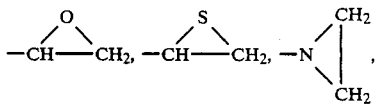

—$CONHCH_2OR_{12}$ (wherein $R_{12}$ represents a hydrogen atom or an alkyl group having from 1 to 8 carbon atoms (e.g., methyl, ethyl, propyl, butyl, hexyl, and octyl)), —N=C=0, and a group containing polymerizable double bond

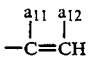

wherein $a_{11}$ and $a_{12}$ each represents a hydrogen atom, a halogen atom (e.g. chlorine and bromine) or an alkyl group having from 1 to 4 carbon atoms (e.g., methyl and ethyl)). Specific examples of the group containing the polymerizable double bond include $CH_2$=CH—, $CH_2$=CH—$CH_2$—,

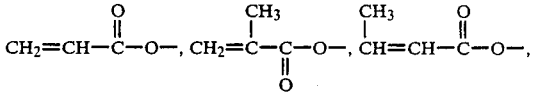

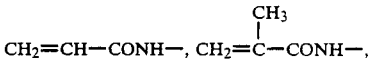

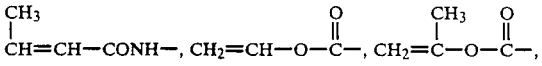

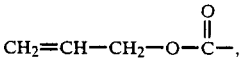

$CH_2$=CH—NHCO—, $CH_2$=CH—$CH_2$—NHCO—, $CH_2$=CH—$SO_2$—, $CH_2$=CH—CO—, $CH_2$=CH—O—, and $CH_2$=CH—S—.

Incorporation of the above-described curing functional group can be carried out by a method of introducing the functional group into a polymer by a high polymer reactions or a method of copolymerizing a monomer containing one or more of these functional groups and a monomer corresponding to the repeating unit (a-i).

The high polymer reaction can be performed utilizing known techniques of low-molecular weight synthesis. Reference can be made to e.g., Nippon Kagakukai (ed.), *Shin Jikken Kaqaku Koza*, Vol. 14, "Yuki Kagobutsu no Gosei" to Han-no (I)-(V), Maruzen K. K., and Yoshio Iwakura and Keisuke Kurita, *Han-nosei Koibunshi*.

The monomer containing one or more light- and/or heat-curing functional groups includes vinyl compounds copolymerizable with the monomer corresponding to the repeating unit (a-i) and containing the functional group. Examples of such vinyl compounds are described, e.g., in Kobunshi Gakkai (ed.), *Kobunchi Data Handbook* (*Kisohen*), Baihukan (1986). Specific examples of these vinyl monomers are acrylic acid, α- and/or β-substituted acrylic acids (e.g., α-acetoxy, α-acetoxymethyl, α-(2-amino)-methyl, α-chloro, α-bromo, α-fluoro, α-tributylsilyl, α-cyano, β-chloro, β-bromo, α-chloro-62 -methoxy, and α,β-dichloro compounds), methacrylic acid, itaconic acid, itaconic half esters, itaconic half amides, crotonic acid, 2-alkenylcarboxylic acids (e.g., 2-pentenoic acid, 2-αmethyl-2-hexenoic acid, and 4-ethyl-2-octenoic acid), maleic acid, maleic half esters, maleic half amides, vinylbenzenecarboxylic acid, vinylbenzenesulfonic acid, vinylsulfonic acid, vinylphosphonic acid, vinyl or allyl half ester derivatives of dicarboxylic acids, and ester or amide derivatives of these carboxylic acids or sulfonic acids containing the acidic group in the substituents thereof.

Specific examples of the heat- and/or photocurable functional group-containing repeating unit (a-ii) are shown below.

(ii-1)

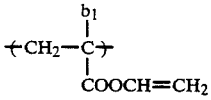

$b_1$: —H, —$CH_3$ (hereinafter the same)

(ii-2)

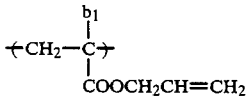

(ii-3)

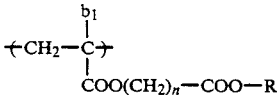

R: —CH=$CH_2$, —$CH_2$CH=$CH_2$
n: integer of 1 to 11

(ii-4)

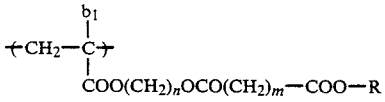

R: —CH=$CH_2$, —$CH_2$CH=$CH_2$
n, m: integer of 1 to 11

(ii-5)

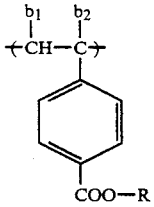

R: —CH=$CH_2$, —$CH_2$CH=$CH_2$
$b_2$: H, $CH_3$ (hereinafter the same)

(ii-6)

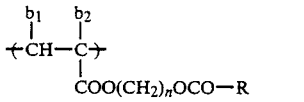

R: —CH=$CH_2$, —C(CH3)=$CH_2$, —CH=CH—$CH_3$
n: integer of 1 to 11

-continued (ii-7)

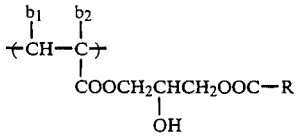

R: —CH=$CH_2$, —$CH_2$CH=$CH_2$, —C(CH3)=$CH_2$,

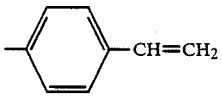

(ii-8)

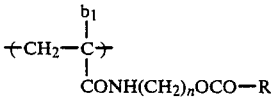

R: —CH=$CH_2$, —C(CH3)=$CH_2$, —CH=CH—$CH_3$
n: integer of 1 to 10

(ii-9)

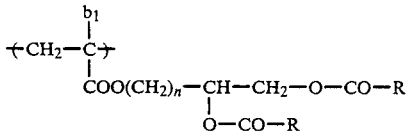

R: —CH=$CH_2$, —C(CH3)=$CH_2$, 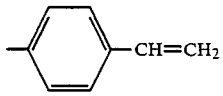

n: integer of 1 to 4

(ii-10)

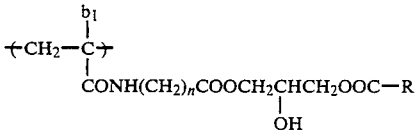

R: —CH=$CH_2$, —C(CH3)=$CH_2$, —CH=CH—$CH_3$
n: integer of 1 to 11

(ii-11)

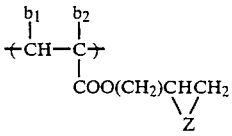

n: integer of 1 to 4
Z: —S—, —O—, (ii-12)

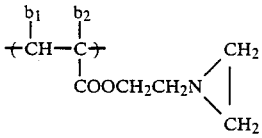

(ii-13)

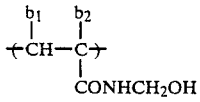

(ii-14)

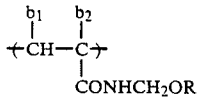

R: $C_1$-$C_4$ alkyl group

-continued

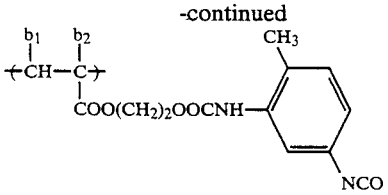
(ii-15)

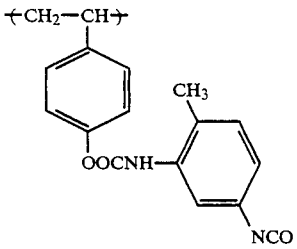
(ii-16)

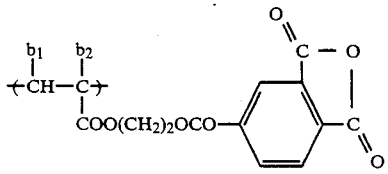
(ii-17)

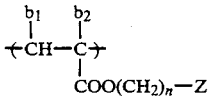
(ii-18)

Z: —OH, —$NH_2$
n: integer of 2 to 11

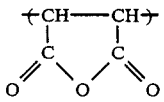
(ii-19)

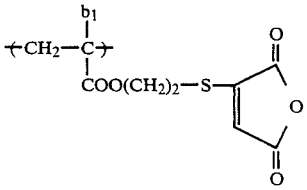
(ii-20)

Resin (A) may further comprise other copolymerizable monomers in addition to the monomer corresponding to the repeating unit of formula (I) or (II) and, if desired, the heat- and/or photo-curable functional group-containing monomer. Examples of such monomers e unsaturated carboxylic acid esters, such as methacrylic esters, acrylic esters, crotonic esters and itaconic diesters (the ester groups of these unsaturated carboxylic acids including methyl, ethyl, propyl, butyl, heptyl, hexyl, octyl, decyl, dodecyl, 2-hydroxyethyl, 2-chloroethyl, 2-methoxyethyl, methoxymethyl, ethoxymethyl, 2,3-dihydroxypropyl, 2-(N,N-dimethylamino)ethyl, 2-(N-morpholino)ethyl, 2-furylethyl, benzyl, phenethyl, cyclohexyl and phenyl groups), α-olefins, vinyl alkanoates, allyl alkanoates, acrylonitrile, methacrylamides, styrenes, and heterocyclic vinyl compounds (e.g., vinylpyrrolidone, vinylpyridine, vinylimidazole, vinylthiophene, vinylimidazoline, vinylpyrazoles, vinyldioxane, vinylquinoline, vinylthiazole, and vinyloxazine).

Any of the binder resins conventionally employed in electrophotographic photoreceptors can be used as resin (B) as long as the molecular weight requirement is satisfied. Resin (B) may be used either individually or as a combination of two or more thereof. Specific examples of usable resins (B) are described in Harumi Miyahara and Hidehiko Takei, *Imaging,* Vol. 1978, No.8, pp. 9–12, and Takaharu Kurita and Jiro Ishiwatari, *Kobunchi,* Vol. 17, pp. 278–284 (1968).

Specific examples of resin (B) include olefin polymer and copolymers, vinyl chloride copolymers, vinylidene chloride copolymers, vinyl alkanoate polymers and copolymers, allyl alkanoate polymers and copolymers, polymers and copolymers of styrene derivative or derivatives thereof, butadiene-styrene copolymers, isoprene-styrene copolymers, butadiene-unsaturated carboxylic acid ester copolymers, acrylonitrile copolymers, methacrylonitrile copolymers, alkyl vinyl ether copolymers, acrylic ester polymers or copolymers, methacrylic ester polymers or copolymers, styrene-acrylic ester copolymers, styrene-methacrylic ester copolymers, itaconic diester polymers or copolymers, maleic anhydride copolymers, acrylamide copolymers, methacrylamide copolymers, hydroxyl-modified silicone resins, polycarbonate resins, ketone resins, amide resins, hydroxyl- and carboxyl-modified polyester resins, butyral resins, polyvinylacetal resins, cyclized rubber-methacrylic ester copolymers, cyclized rubber-acrylic ester copolymers, copolymers containing a heterocyclic ring containing no nitrogen atom (heterocyclic ring including furan, tetrahydrofuran, thiophene, dioxane, dioxolane, lactone, benzofuran, benzothiophene, and 1,3-dioxetane rings), and epoxy resins.

In one embodiment, resin (B) preferably includes (meth)acrylate polymers or copolymers containing not less than 30% by weight of a (meth)acrylic ester unit represented by formula (III):

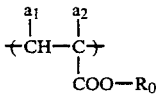
(III)

wherein $a_1$ and $a_2$, which may be the same or different, each represents a hydrogen atom, a halogen atom (chlorine atom and bromine atom), a cyano group, or an alkyl group having from 1 to 4 carbon atoms; and $R_o$ represents a substituted or unsubstituted alkyl group having from 1 to 18 carbon atoms (e.g., methyl, ethyl, propyl, butyl, pentyl, hexyl, octyl, decyl, dodecyl, tridecyl, tetradecyl, 2-methoxyethyl, and 2-ethoxyethyl), a substituted or unsubstituted alkenyl group having from 2 to 18 carbon atoms (e.g., vinyl, allyl, isopropenyl, butenyl, hexenyl, heptenyl, and octenyl), a substituted or unsubstituted aralkyl group having from 7 to 12 carbon atoms (e.g., benzyl, phenethyl, methoxybenzyl, ethoxybenzyl, and methylbenzyl), a substituted or unsubstituted cycloalkyl group having form 5 to 8 carbon atoms (e.g., cyclopentyl, cyclohexyl, and cycloheptyl), and an aryl group (e.g., phenyl, tolyl, xylyl, mesityl, naphthyl, methoxyphenyl, methoxyphenyl, chlorophenyl, dichlorophenyl, bromophenyl, chloromethylphenyl, bromochlorophenyl, butylphenyl, methoxycarbonylphenyl, phenoxyphenyl, and cyanophenyl).

The above-described preferred resin (B) is particularly advantageous in that an offset master plate produced form the resulting photoreceptor does not have background stains on printing.

In formula (III), $a_1$ and $a_2$ each preferably represents a hydrogen atom or a melhyl group.

Where $a_1$ and $a_2$ both represent a hydrogen atom, and $R_o$ represents an alkyl group having from 6 to 18 carbon atoms, the proportion of such a component in the resin (B) is preferably not more than 60% by weight.

In this embodiment, resin (B) preferably includes a random copolymer containing from 0.05 to 5% by weight of a copolymerization component containing the above-specified acidic group in addition to the polymerization component (b-i) of formula (III).

The polymerization component containing the specific acidic group may be any of compounds copolymerizable with the monomer corresponding to the polymerization component of formula (III). Examples of usable compounds are those described above with respect to the resin (A).

It is important in this embodiment for resin (B) containing the acidic group-containing copolymerization component to have a weight average molecular weight of not more than $1\times10^5$. It is particularly preferable for the content of the acidic group-containing component in the resin (B) to range from 1 to 60% by weight of that in the resin (A).

In another embodiment, resin (B) is preferably a copolymer containing from 1 to 30% by weight of at least one component containing a heat- and/or light-curable functional group. The heat- and/or light-curable functional group as herein referred to includes those described above with respect to repeating unit (a-ii) of the resin (A).

The component copolymerizable with the unsaturated carboxylic ester includes not only monomers corresponding to the repeating unit of formula (III) but other monomers, such as α-olefins, vinyl alkanoates, allyl alkanoates, acrylonitrile, methacrylonitrile, vinyl ethers, acrylamides, methacrylamides, styrenes (e.g., styrene, vinyltoluene, vinylnaphthalene, butylstyrene, methoxystyrene, chlorostyrene, dichlorostyrene, and bromostyrene), heterocyclic vinyl compounds (e.g., vinylpyrrolidone, pyridine, vinylimidazole, vinylthiophene, vinylimidazoline, vinylpyrazole, vinyldioxane, vinylquinoline, vinylthiazole, and vinyloxazine); compounds described in Kobunshi Gakkai (ed.), *Kobunshi Data Handbook* (*Kosohen*), pp. 175–181, D. A. Tomalia, *Reactive Heterocyclic Monomers,* Ch. 1 of "Functional Monomers Vol. 2", Marcel DeRRer Inc., N.Y. (1974), and L. S. LusRin, *Basic Monomers,* Ch. 3 of "Functional Monomers Vol. 2", Marcel DeRRer Inc., N.Y. (1974); and compounds of formula (III) wherein $R_o$ is displaced with another substituent, such as an alkyl group having from 1 to 6 carbon atoms substituted with a halogen atom (e.g., fluorine, chlorine, bromine, and iodine), a hydroxyl group, a cyano group, an amino group, a heterocyclic group, a silyl group, —$CONH_2$, etc. (e.g., 2-chloroethyl, 2-bromoethyl, 2,2,2-trifluoroethyl, 2,3-dibromopropyl, 2-hydroxyethyl, 3-hydroxypropyl, 2,3-dihydroxypropyl, 3-chloro-2-hydroxypropyl, 2-cyanoethyl, 3-(trimethoxysilyl)propyl, 2-furylethyl, 2-thienylethyl, 2-(n-morpholino)ethyl, 2-amidoethyl, 2-methylsulfonylethyl, 2-(N,N-dimethylamino)ethyl, and 2-(N,N-diethylamino)ethyl.

Other copolymerization components which may constitute resin (B) are not limited to the foregoing monomers. It is preferable that the proportion of each of these copolymerization components should not exceed 30% by weight, more preferably 20% by weight, of the resin (B).

In the present invention, particularly when the binder resin contains a heat- and/or light-curable functional group, it is preferable to use a reaction accelerator for accelerating crosslinking in the photoconductive layer.

Where crosslinking is effected through formation of a chemical bond between functional group, suitable reaction accelerator which can be used include organic acid type crosslinking agents (e.g., acetic acid, propionic acid, butyric acid, benzenesulfonic acid, and p-toluenesulfonic acid). The compounds described in Shinzo Yamashita and Tosuke Kaneko (ed.), *Kakyozai Handbook,* Taiseisha (1981) can also be used as a crosslinking agent. For example, generally employed crosslinking agents, such as organosilanes, polyurethanes, and polyisocyanates, and curing agents, such as epoxy resins and melamine resins, can be used.

Where crosslinking is effected through a polymerization reaction, suitable reaction accelerators which can be used include polymerization initiators (such as peroxides and azobis compounds, preferably azobis type polymerization initiators) and polyfunctional polymerizable group-containing monomers (e.g., vinyl methacrylate, allyl methacrylate, ethylene glycol diacrylate, polyethylene glycol diacrylate, divinylsuccinic esters, divinyladipic esters, diallylsuccinic esters, 2-methylvinyl methacrylate, and divinylbenzene).

Where the binder resin contains a light-crosslinkable functional group, a sensitizer, a photopolymerizable monomer, and the like may be added. More specifically, compounds described in the literature cited above with respect to the photosensitive resins can be used.

When the binder resin contains a heat-curable functional group, the photoconductive substance-binder resin dispersed system is subjected a heat-curing treatment. The heat-curing treatment can be carried out by drying the photoconductive coating under conditions more severe than those generally employed for the preparation of conventional photoreceptors. For example, the heat-curing can be achieved by drying the coating at a temperature of from 60° to 120° C. for 5 to 120 minutes. Where the binder resin contains a light-curing functional group, the coating is subjected a light-curing treatment by application of electron beams, x-rays, ultraviolet rays or plasma rays. The light-curing treatment may be effected either during drying or before or after drying. The reaction can be accelerated by employing the above-stated drying conditions. The use of the aforesaid reaction accelerator in combination with the binder resin containing the heat- and/or light-curing functional group makes it possible to conduct curing under milder conditions.

The above-described crosslinking accelerator is preferably used in an amount of from 1 to 30% by weight based on the total binder resin.

The above-described resin (B) may be used either individually or as a combination of two or more thereof.

The ratio of resin (A) to resin (B) varies depending on the kind, particle size, and surface conditions of the inorganic photoconductive material used. In general, the weight ratio of resin (A) to resin (B) is 5 to 80:95 to 20, preferably 10 to 60:90 to 40.

The inorganic photoconductive material which can be used in the present invention includes zinc oxide, titanium oxide, zinc sulfide, cadmium sulfide, cadmium carbonate, zinc selenide, cadmium selenide, tellurium selenide, and lead sulfide.

The resin binder is used in a total amount of from 10 to 100 parts by weight, preferably from 15 to 50 parts by weight, per 100 parts by weight of the inorganic photoconductive material.

If desired, the photoconductive layer according to the present invention may contain various spectral sensitizers. Examples of suitable spectral sensitizers are carbonium dyes, diphenylmethane dyes, triphenylmethane dyes, xanthene dyes, phthalein dyes, polymethine dyes (e.g., oxonol dyes, merocyanine dyes, cyanine dyes, rhodacyanine dyes, and styryl dyes), phthalocyanine dyes (inclusive of metallized dyes), and the like.

Specific examples of suitable carbonium dyes, triphenylmethane dyes, xanthene dyes, and phthalein dyes are described in JP-B-No. 51-452, JP-A-Nos. 50-90334, 50-114227, 53-39130, 53-82353, U.S. Pat. Nos. 3,052,540 and 4,054,450, and JP-A-No. 57-16456.

Suitable polymethine dyes, such as oxonol dyes, merocyanine dyes, cyanine dyes, and rhodacyanine dyes, include those described in F. M. Harmmer, *The cyanine Dyes and Related Compounds.* Specific examples are described in U.S. Pat. Nos. 3,047,384, 3,110,591, 3,121,008, 3,125,447, 3,128,179, 3,132,942, and 3,622,317, British Pat. Nos. 1,226,892, 1,309,274 and 1,405,898, JP-B-Nos. 48-7814 and 55-18892.

In addition, polymethine dyes capable of spectrally sensitization in the longer wavelength region of 700 nm or more, i.e., from the near infrared region to the infrared region, include those described in JP-A-Nos. 47-840, 47-44180, JP-B-No. 51-41061, JP-A-Nos. 49-5034, 49-45122, 57-46245, 56-35141, 57-157254, 61-26044, 61-27551, U.S. Pat. Nos. 3,619,154 and 4,175,956, and Research Disclosure, 216, pp. 117–118 (1982).

The photoreceptor of the present invention is particularly excellent in that the performance properties are tend not to vary even when combined with various kinds of sensitizing dyes.

If desired, the photoconductive layer may further contain various additives commonly employed in a electrophotographic photoconductive layer, such as chemical sensitizers. Examples of such additives include electron-accepting compounds (e.g., halogen, benzoquinone, chloranil, acid anhydrides, and organic carboxylic acids) described in Imaging, vol. 1973, No. 8, p,. 12 supra; and polyarylalkane compounds, hindered phenol compounds, and p-phenylenediamine compounds described in Hiroshi Komon, et al., *Saikin-no Kododen Zairyo to Kankotai no Kaihatsu Jitsuyoka,* Chaps. 4 to 6, Nippon Kagaku Joho K.K. (1986).

The amount of these additives is not particularly critical and usually ranges from 0.0001 to 2.0 parts by weight per 100 parts by weight of the photoconductive substance.

The photoconductive layer of the photoreceptor suitably has a thickness of from 1 to 100 μm, particularly from 10 to 50 μm.

Where the photoconductive layer functions as a charge generating layer in a laminated photoreceptor comprising a charge generating layer and a charge transporting layer, the thickness of the charge generating layer suitably ranges from 0.01 to 1 μm, particularly from 0.05 to 0.5 μm.

Charge transporting materials useful in the above-described laminated photoreceptor include polyvinylcarbazole, oxazole dyes, pyrazoline dyes, and triphenylmethane dyes. The thickness of the charge transporting layer ranges from 5 to 40 μm, preferably from 10 to 30 μm.

Resins which can be used in the insulating layer or the charge transporting layer typically include thermoplastic and thermosetting resins, e.g., polystyrene resins, polyester resins, cellulose resins, polyether resins, polyester resins, cellulose resins, polyether resins, vinyl chloride resins, vinyl acetate resins, vinyl chloride-vinyl acetate copolymer resins, polyacrylate resins, polyolefin resins, urethane resins, epoxy resins, melamine resins, and silicone resins.

The photoconductive layer according to the present invention can be provided on any known support. In general, a support for an electrophotographic photosensitive layer is preferably electrically conductive. Any of conventionally employed conductive supports may be utilized in this invention. Examples of usable conductive supports includes a base, e.g., a metal sheet, paper, a synthetic resin sheet, etc., having been rendered electrically conductive by, for example, impregnation with a low resistant substance; the above-described base with the back side thereof (opposite to the photosensitive layer side) being rendered conductive and having further coated thereon at least one layer for the purpose of prevention of curling the above-described supports having thereon a water-resistant adhesive layer; the above-described supports having thereon at least one precoat layer; and paper laminated with a synthetic resin film on which aluminum, etc. is deposited.

Specific examples of conductive supports and materials for imparting conductivity are described in Yuko Sakamoto, *Denshishashi,* Vol. 14, No. 1, pp. 2–11 (1975), Hiroyui Moriga, *Nyumon Tokushushi no Kaqaku,* Kobunshi Kankokai (1975), and M. F. Hoover, *J. Macromol. Sci. Chem.,* A-4(6), pp. 1327–1417 (1970).

The present invention will now be illustrated in greater detail by way of Synthesis Examples, Examples and Comparative Examples, but it should be understood that the present invention is not deemed to be limited thereto. Unless otherwise indicated herein, all parts, percents, ratios and the like are by weight.

SYNTHESIS EXAMPLE 1

Synthesis of Resin (A-1)

A solution of a mixture of 95 g of 2-chloro-6-methylphenyl methacrylate, 150 g of toluene, and 50 g of isopropanol was heated to 80° C. in a nitrogen stream, and 5 g of 4,4'-azobis(4-cyanovaleric acid) was added thereto to effect polymerization for 10 hours. The resulting resin [designated (A-1)] had a weight average molecular weight (hereinafter abbreviated as Mw) of 6500 and the following chemical structure.

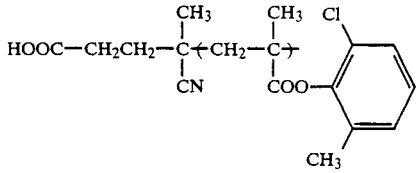

SYNTHESIS EXAMPLES 2 TO 23

Synthesis of Resins (A-2) to (A-23)

Resins (A) of Table 1 below were synthesized from the corresponding monomers under the same polymerization conditions as in Synthesis Examples 1. These resins had a Mw between 6000 to 8000.

TABLE 1
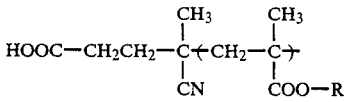
| Synthesis Example No. | Resin (A) No. | Ester Substituent R |
|---|---|---|
| 2 | (A-2) | 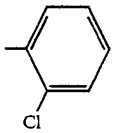 |
| 3 | (A-3) | 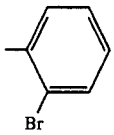 |
| 4 | (A-4) | 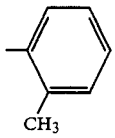 |
| 5 | (A-5) | 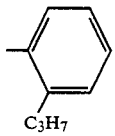 |
| 6 | (A-6) | 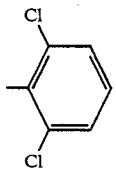 |
| 7 | (A-7) | 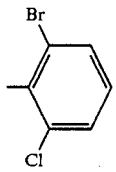 |
| 8 | (A-8) | 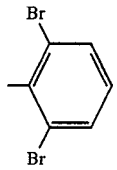 |
| 9 | (A-9) | 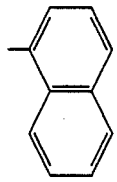 |
| 10 | (A-10) | 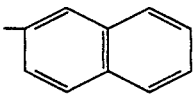 |
TABLE 1-continued
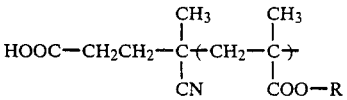
| Synthesis Example No. | Resin (A) No. | Ester Substituent R |
|---|---|---|
| 11 | (A-11) | 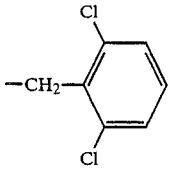 |
| 12 | (A-12) | 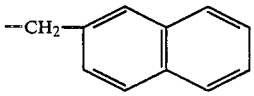 |
| 13 | (A-13) | 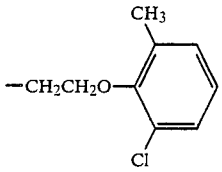 |
| 14 | (A-14) | 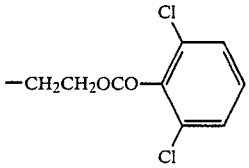 |
| 15 | (A-15) | 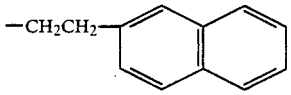 |
| 16 | (A-16) | 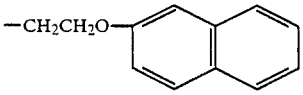 |
| 17 | (A-17) | 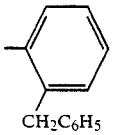 |
| 18 | (A-18) | 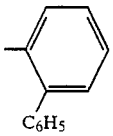 |
| 19 | (A-19) | 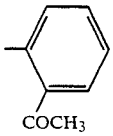 |

TABLE 1-continued

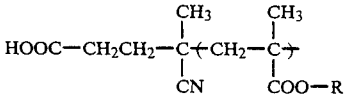

| Synthesis Example No. | Resin (A) No. | Ester Substituent R |
|---|---|---|
| 20 | (A-20) | 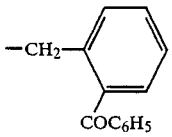 |
| 21 | (A-21) | 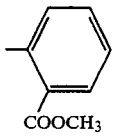 |
| 22 | (A-22) | 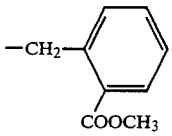 |
| 23 | (A-23) | 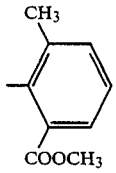 |

SYNTHESIS EXAMPLE 24

Synthesis of Resin (A-24)

A solution of a mixture of 97 g of 2,6-dichlorophenyl methacrylate, 3 g of thioglycolic acid, 150 g of toluene, and 50 g of isopropanol was heated to 65° C. in a nitrogen stream, and 0.8 g of azobisisobutyronitrile was added thereto and the reaction was conducted for 8 hours. The resulting copolymer (A-24) had an Mw of 7800 and the following chemical structure:

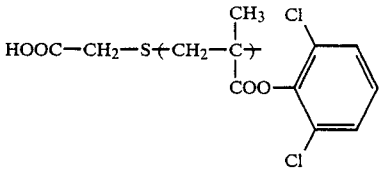

SYNTHESIS EXAMPLES 25 TO 35

Synthesis of Resins (A-25) to (A-35)

Resins (A) shown in Table 2 below were synthesized under the same polymerization conditions as in Synthesis Example 24, except for replacing thioglycolic acid as used in Synthesis Example 24 with each of the compounds of Table 2. These resins had an Mw between 7500 and 8500.

TABLE 2

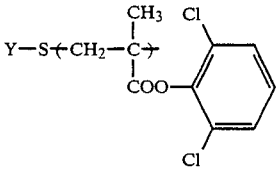

| Synthesis Example No. | Resin (A) No. | Y | Chain Transfer Agent |
|---|---|---|---|
| 25 | A-25 | $HOOC(CH_2)_2$ | $HS(CH_2)_2-COOH$ |
| 26 | A-26 | HOOC—CH(HOOC—$CH_2$)— | HS—CH($CH_2$—COOH)—COOH |
| 27 | A-27 | 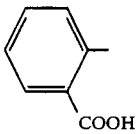 | 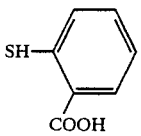 |
| 28 | A-28 | $HO_3S(CH_2)_2$— | $HS(CH_2)_2-SO_3H$ |
| 29 | A-29 | HO—P(=O)(OH)—O—$(CH_2)_3$— | HS$(CH_2)_3$—O—P(=O)(OH)—OH |

TABLE 2-continued
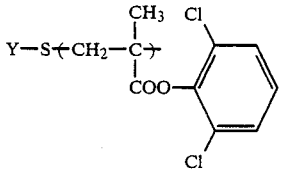
| Synthesis Example No. | Resin (A) No. | Y | Chain Transfer Agent |
|---|---|---|---|
| 30 | A-30 | 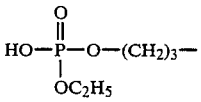 | 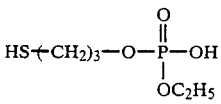 |
| 31 | A-31 | $HOOC(CH_2)_2OCHN(CH_2)_2-$ | $HS(CH_2)_2NHCO(CH_2)_2COOH$ |
| 32 | A-32 | 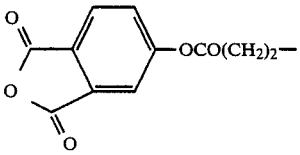 | 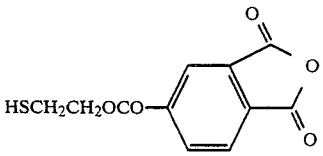 |
| 33 | A-33 | 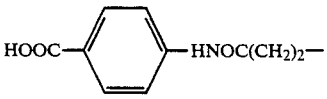 | 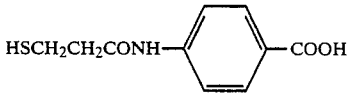 |
| 34 | A-34 | 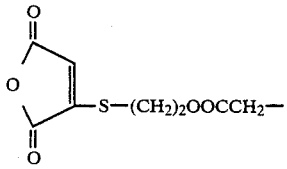 | 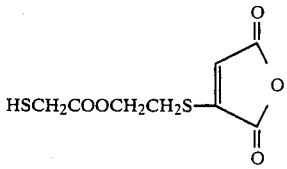 |
| 35 | A-35 | 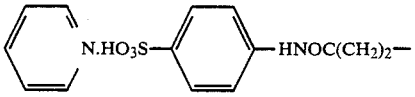 | 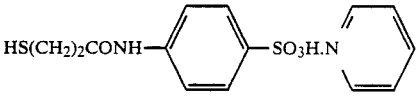 |
SYNTHESIS EXAMPLES 36 TO 48
Synthesis of Resins (A-36) to (A-48)
Resins (A) shown in Table 3 were synthesized under the same polymerization conditions as in the foregoing Synthesis Examples.
TABLE 3
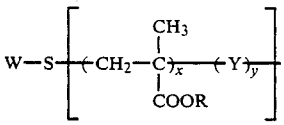
| Synthesis Example No. | Resin (A) No. | W— | R | x* | Y | y* | $\overline{M}w$ |
|---|---|---|---|---|---|---|---|
| 36 | A-36 | $HOOCH_2C-$ | 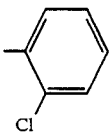 | 85 | 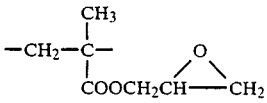 | 15 | 7,500 |

TABLE 3-continued
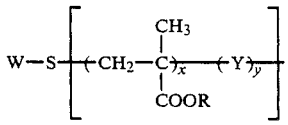
| Synthesis Example No. | Resin (A) No. | W— | R | x* | Y | y* | $\overline{M}w$ |
|---|---|---|---|---|---|---|---|
| 37 | A-37 | $HOOC(CH_2)_2$— | 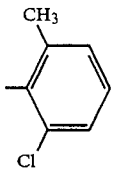 | 90 | 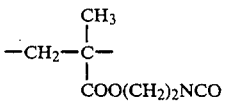 | 10 | 7,300 |
| 38 | A-38 | 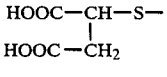 | 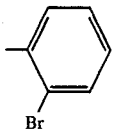 | 85 | 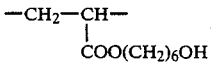 | 15 | 7,600 |
| 40 | A-40 | 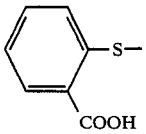 | 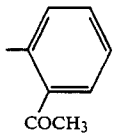 | 90 | 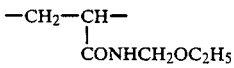 | 10 | 7,800 |
| 41 | A-41 | $HOOC-CH_2$— | 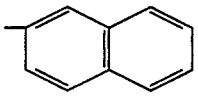 | 90 | 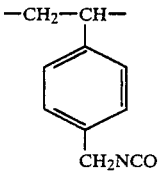 | 10 | 8,000 |
| 42 | A-42 | $HOOCH_2C$— | 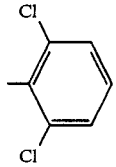 | 100 | 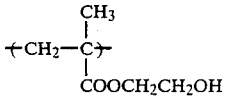 | 10 | 7,300 |
| 43 | A-43 | 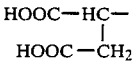 | 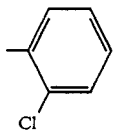 | 92 | 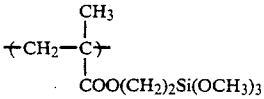 | 8 | 7,800 |
| 44 | A-44 | 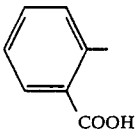 | 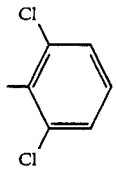 | 90 | 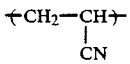 | 10 | 8,100 |
| 45 | A-45 | " | 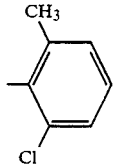 | 90 | 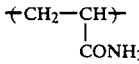 | 10 | 8,300 |

TABLE 3-continued

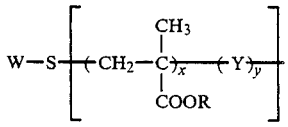

| Synthesis Example No. | Resin (A) No. | W— | R | x* | Y | y* | $\overline{M}w$ |
|---|---|---|---|---|---|---|---|
| 46 | A-46 | " | 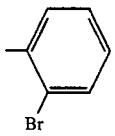 | 85 | 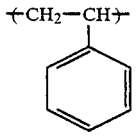 | 15 | 7,200 |

SYNTHESIS EXAMPLE 47

Synthesis of Resin (A-47)

In the same manner as in the foregoing Synthesis Examples, a copolymer (A-31) having a weight average molecular weight of 9500 and the following chemical structure was prepared.

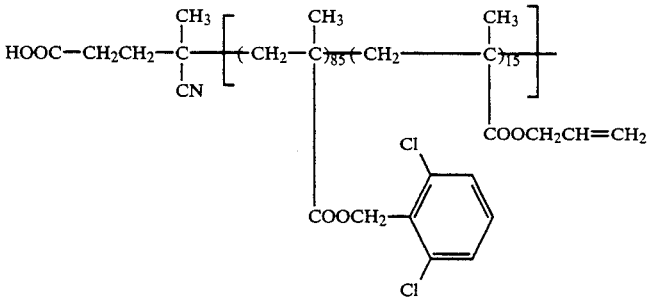

(copolymerization ratio by weight)

SYNTHESIS EXAMPLES 48 TO 53

Synthesis of Resins (A-48) to (A-53)

Resins (A) shown in Table 4 below were prepared in the same manner as in Synthesis Example 47.

TABLE 4

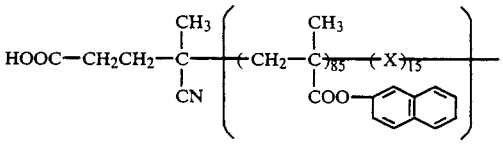

(copolymerization ratio: by weight)

| Synthesis Example No. | Resin (A) No. | Copolymerization Component: X | $\overline{M}w$ |
|---|---|---|---|
| 48 | A-48 | 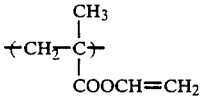 | 8,400 |
| 49 | A-49 | 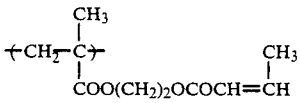 | 9,300 |

TABLE 4-continued

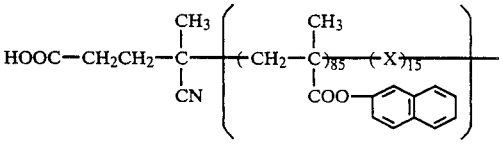

(copolymerization ratio: by weight)

| Synthesis Example No. | Resin (A) No. | Copolymerization Component: X | $\overline{M}w$ |
|---|---|---|---|
| 50 | A-50 | 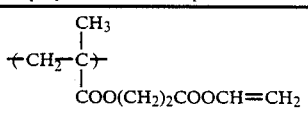 | 8,600 |
| 51 | A-51 | 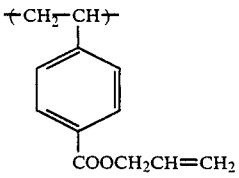 | 7,300 |
| 52 | A-52 | 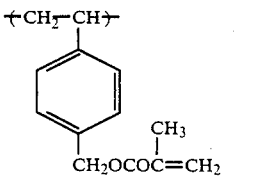 | 8,200 |

TABLE 4-continued

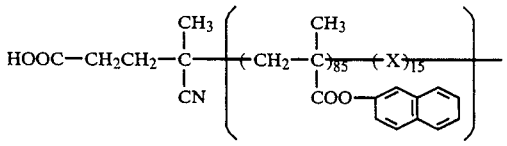

(copolymerization ratio: by weight)

| Synthesis Example No. | Resin (A) No. | Copolymerization Component: X | $\overline{M}w$ |
|---|---|---|---|
| 53 | A-53 | $\leftarrow CH_2-C(CH_3)(COO(CH_2)_2SO_2OCH_2CH{=}CH_2)\rightarrow$ | 6,500 |

EXAMPLE 1

A mixture of 6 g (solid basis) of (A-1) prepared in Synthesis Example 1, 34 g (solid basis) of polyethyl methacrylate [Mw: 3.6×105; hereinafter referred to as (B-1)], 200 g of zinc oxide, 0.018 g of cyanine dye (A) shown below, 0.30 g of phthalic anhydride, and 300 g of toluene was dispersed in a ball mill for 3 hours. The resulting photosensitive composition was coated on paper, rendered electrically conductive with a wire bar to a dry thickness of 22 g/m$^2$, followed by drying at 110° C. for 30 seconds. The coating was allowed to stand in a dark place at 20° C. and 65% RH (relative humidity) for 24 hours to prepare an electrophotographic photoreceptor.

Cyanine Dye (A)

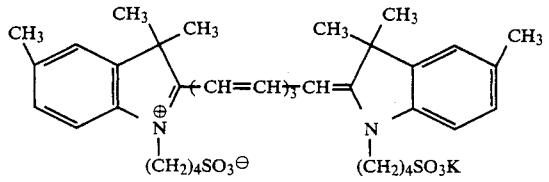

EXAMPLE 2

An electrophotographic photoreceptor was prepared in the same manner as in Example 1, except for replacing 34 g of (B-1) with 34 g of (B-2) shown below.

(B-2)

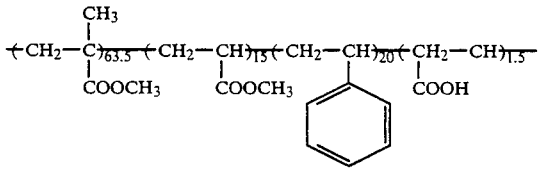

(Mw: 6.5 × 10$^4$) Copolymerization ratio: by weight, hereinafter the same)

EXAMPLE 3

A mixture of 8 g of (A-24), 32 g of (B-3) shown below, 200 g of zinc oxide, 0.018 g of cyanine dye (A), 0.30 g of phthalic anhydride, and 300 g cyanine dye (A), 0.30 g of phthalic anhydride, and 300 g of toluene was dispersed in a ball mill for 2 hours, and 2 g of 1,3-xylylene diisocyanate was added thereto, followed by dispersion in a ball mill for 10 minutes. The resulting composition was coated on paper, having rendered electrically conductive, with a wire bar to a dry thickness of 22 g/m$^2$, and dried at 100° C. for 12 second and then at 120° C. for 2 hours. Then, the coating was allowed to stand in a dark place at 20° C. and 65% RH for 24 hours to obtain an electrophotographic photoreceptor.

(B-3)

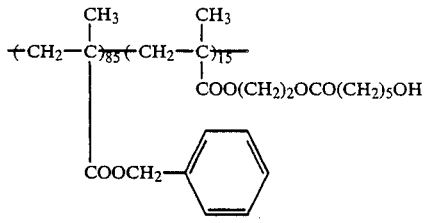

(Mw: 5.6 × 10$^4$)

COMPARATIVE EXAMPLE A

An electrophotographic photoreceptor (designated Sample A) was prepared in the same manner as in Example 1, except for replacing 6 g of (A-1) with 6 g of (R-1) shown below.

(R-1)

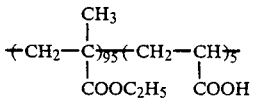

(Mw: 7.6 × 10$^3$)

COMPARATIVE EXAMPLE B

An electrophotographic photoreceptor (Sample B) was prepared in the same manner as in Example 1, except for replacing (A-1) and (B-1) with 40 g of (B-2) as used in Example 2.

The film properties of each of the photoreceptors obtained in Examples 1 to 3 and Comparative Examples A to B was evaluated in terms of surface smoothness and mechanical strength; electrostatic characteristics; image forming performance; oil-desensitivity when used as an offset master plate precursor (expressed in terms of contact angle with water after oil-desensitization treatment); and printing durability when used as an offset master plate according to the following test methods. The results obtained are shown in Table 5 below:

(1) Smoothness of Photoconductive Layer:

The smoothness (sec/cc) was measured using a Beck's smoothness tester manufactured by Kumagaya Riko K.K. under an air volume condition of 1 cc.

(2) Mechanical Strength of Photoconductive Layer:

The surface of the photoreceptor was repeatedly rubbed with emery paper (#1000) under a load of 50 g/cm$^2$ using a Heidon 14 Model surface testing machine (manufactured by Shinto Kagaku K.K.). After dusting, the abrasion loss of the photoconductive layer was measured to obtain film retention (%).

(3) Electrostatic Characteristics:

The sample was charged with a corona discharge to a voltage of −6 kV for 20 seconds in a dark room at 20°

C. and 65% RH using a paper analyzer ("Paper Analyzer SP-428" manufactured by Kawaguchi Denki K.K.). The second after the corona discharge, the surface potential $V_{10}$ was measured. The sample was allowed to stand in dark for an additional 120 seconds, and the potential $V_{130}$ was measured. The dark decay retention (DRR; %), i.e., percent retention of potential after dark decay for 120 seconds, was calculated from the following:

$$DRR\ (\%) = (V_{130}/V_{10}) \times 100$$

Separately, the sample was charged to −400 V with a corona discharge and then exposed to light emitted by a gallium-aluminum-arsenide semi-conductor laser (oscillation wavelength: 780 nm), and the time required for decay of the surface potential $V_{10}$ to one-tenth was measured to obtain an exposure $E_{1/10}$ (erg/cm$^2$).

The measurements were conducted under conditions of 20° C. and 65% RH (hereinafter referred to as Condition I) or 30° C. and 80% RH (hereinafter referred to as Condition II).

(4) Image Forming Performance:

After samples were allowed to stand for one day at 20° C. and 65% RH (Condition I) or at 30° C. and 80% RH (Condition II), each sample was charged to −6 kV and exposed to light emitted from a gallium-aluminum-arsenic semi-conductor laser (oscillation wavelength: 780 nm; output: 2.8 mW) at an exposure amount of 56 erg/cm$^2$ (on the surface of the photoconductive layer) at a pitch of 25 μm and a scanning speed of 280 m/sec. The electrostatic latent image was developed with a liquid developer ("ELP-T" produced by Fuji Photo Film Co., Ltd.), followed by fixing. The reproduced image was visually evaluated for fog and image quality.

(5) Contact Angle With Water:

The sample was passed once through an etching processor using an oil-desensitizing solution ("ELP-E" produced by Fuji Photo Film Co., Ltd.) to render the surface of the photoconductive layer oil-desensitive. On the thus oil-desensitized surface was placed a drop of 2 μl of distilled water, and the contact angle formed between the surface and water was measured using a goniometer.

(6) Printing Durability:

The sample was processed in the same manner as described in (4) above, and the surface of the photoconductive layer was subjected to oil-desensitization under the same conditions as in (5) above. The resulting lithographic printing plate was mounted on an offset printing machine ("Oliver Model 52", manufactured by Sakura Seisakusho K.K.), and printing was carried out on fine paper. The number of prints obtained until background stains in the non-image areas appeared or the quality of the image areas was deteriorated was taken as the printing durability. The larger the number of the prints, the higher the printing durability.

TABLE 5

| | Example 1 | Example 2 | Example 3 | Comparative Example A | Comparative Example B |
|---|---|---|---|---|---|
| Surface Smoothness (Sec/cc) | 130 | 135 | 130 | 140 | 95 |
| Film Strength (%) | 95 | 93 | 98 | 60 | 85 |
| Electrostatic Characteristics: | | | | | |
| $V_{10}$ (−V): | | | | | |
| Condition I | 680 | 675 | 685 | 510 | 530 |
| Condition II | 670 | 660 | 680 | 485 | 415 |
| DRR (%): | | | | | |
| Condition I | 88 | 89 | 87 | 84 | 75 |
| Condition II | 86 | 85 | 86 | 82 | 40 |
| $E_{1/10}$: (erg/cm$^2$) | | | | | |
| Condition I | 17 | 19 | 20 | 45 | 120 |
| Condition II | 18 | 20 | 21 | 53 | 200 or more |
| Image-Forming Performance: | | | | | |
| Condition I | Good | Good | Good | No good (scratches of fine letters or | Poor (cuts of fine letters or lines) |
| Condition II | Good | Good | Good | No good (scratches of fine letters or lines) | Extremely poor (cuts of fine letters or lines) |
| Contact Angle with Water (°C.) | 10 or less | 10 or less | 10 or less | 10 or less | 10 - 20 |
| Printing Durability | 10000 | 10000 | 10000 | 500 | Background stains from the start of printing |

As can be seen from the results in Table 5, each of the photoreceptors according to the present invention exhibited satisfactory surface smoothness and electrostatic characteristics. When each was used as an offset master plate precursor, the reproduced image was clear and free from background stains in the non-image area. While not desiring to be bound, these results appear to be due to sufficient adsorption of the binder resin onto the photoconductive substance and sufficient covering or the surface of the photoconductive particles with the binder resin. For the same reason, oil-desensitization of the offset master plate precursor with an oil-desensitizing solution was sufficient to render the non-image area sufficiently hydrophilic, as shown by a small contact angle of 15° or less with water. On practical printing using the resulting master plate, no background stains were observed in the prints.

Further, the photoconductive layer of each of the photoreceptors of the present invention had a film strength of 88% or more and, when used as an offset master plate, provided more than 8000 prints of clear images free from background stains.

These results demonstrate that the film strength can be markedly improved by the action of resin (A) in combination with resin (B) or in combination with resin (B) and a crosslinking agent without impairing the effects of resin (A).

Sample A, in which a low-molecular weight copolymer resin comprising an alkyl methacrylate unit and an acidic group-containing unit was used, showed considerable improvements in electrostatic characteristics over Sample B, in which only a conventionally known binder resin was used, but was behind the samples of the present invention in characteristics. Actually, when it was processed using a low-output semi-conductor laser at a decreased scanning speed, the reproduced image proved to have insufficient quality.

Printing was carried out using an offset master printing plate produced from Sample A or B. As a result, cuts of thin lines or fine letters from about the 500th print due to the unsatisfactory reproduced image formed on the precursor for the plate of Sample A. Serious background stains from the very start of printing due to the so poor electrostatic characteristics for the plate of Sample B.

From all these consideration, it is thus clear that the electrophotographic photoreceptor satisfying both requirements of electrostatic characteristics and printing suitability cannot be obtained without the binder resin according to the present invention.

EXAMPLES 4 TO 12

An electrophotographic photoreceptor was prepared in the same manner as in Example 1, except for replacing 6 g of (A-1) and 34 g of (B-1) with each of the resins (A) and (B) shown in Table 6, respectively, and replacing cyanine dye (A) with 0.020 g of cyanine dye (B) shown below.

Cyanine Dye (B)

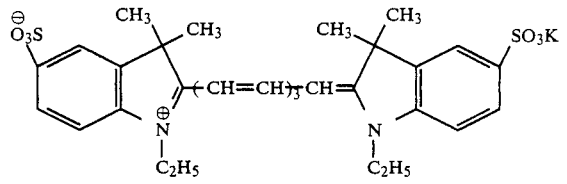

The performance properties of the resulting photoreceptors were evaluated in the same manner as in Example 1, and the results obtained are shown in Table 6 below. The electrostatic characteristics in Table 6 are those determined under Condition II (30° C., 80% RH).

TABLE 6

| Example No. | Resin (A) | | Resin (B) | Electrostatic Characteristics (Condition II) $V_{10}$ | DRR | $E_{1/10}$ (erg/cm$^2$) |
|---|---|---|---|---|---|---|
| 4 | (A-2) | (B-4): | polybutyl methacrylate (Mw = 3.5 × $10^5$) | 630 | 87 | 20 |
| 5 | (A-3) | (B-5): | styene/ethyl methacrylate copolymer (15/85 by weight) (Mw = 1.5 × $10^5$) | 620 | 85 | 2 |
| 6 | (A-4) | (B-6): | polypropyl methacrylate (Mw = 2.5 × $10^5$) | 575 | 84 | 19 |
| 7 | (A-5) | (B-7): | ethyl methacrylate/acrylonitrile copolymer (80/20 by weight) (Mw = 3.5 × $10^5$) | 575 | 85 | 20 |
| 8 | (A-6) | (B-8): | polybenzyl methacrylate (Mw = 2.4 × $10^5$) | 670 | 86 | 18 |
| 9 | (A-7) | (B-9): | methyl methacrylate/methyl acrylate (90/10 by weight) (Mw = 1.8 × $10^5$) | 665 | 87 | 19 |
| 10 | (A-9) | (B-10): | ethyl methacrylate/2-cyanoethyl methacrylate (80/20 by weight) (Mw = 1.0 × $10^5$) | 590 | 88 | 18 |
| 11 | (A-10) | (B-11): | styrene/butyl methacrylate copolymer (80/20 by weight) (Mw = 2.4 × $10^5$) | 585 | 87 | 19 |
| 12 | (A-29) | (B-12): | methyl methacrylate/ethyl methacrylate (40/60 by weight) (Mw = 3.0 × $10^5$) | 665 | 87 | 20 |

It can be seen from the results in Table 6 that each of the photoreceptors according to the present invention had excellent charging properties, dark decay retention, and photosensitivity and provided a clear reproduced image even when processed under severe conditions of high temperature and high humidity (30° C., 80% RH). As offset master plate produced form the photoreceptor of this invention provided more than 8,000 prints having a clear image free from background stains.

EXAMPLES 13 TO 20

An electrophotographic photoreceptor was prepared in the same manner as in Example 3, except for replacing 6 g of (A-24), 32 g of (B-3) with the equal amount of each of the resins (A) and (B) shown in Table 7 below, respectively, and replacing 2 g of 1,3-xylylene diisocyanate (crosslinking agent) with the indicated amount of the crosslinking agent shown in Table 7 below.

TABLE 7

| Example No. | Resin (A) | Resin (B) | | Crosslinking Agent | |
|---|---|---|---|---|---|
| 13 | A-38 | 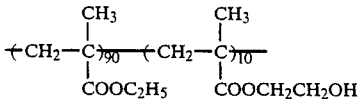 (B-13) | $\overline{M}w$ 38,000 | 1,3-xylylene diisocyanate | 1.5 g |
| 14 | A-36 | 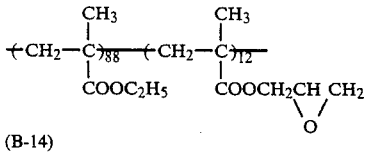 (B-14) | $\overline{M}w$ 40,000 | 1,6-hexa-methylenediamine | 1.3 g |
| 15 | A-27 | 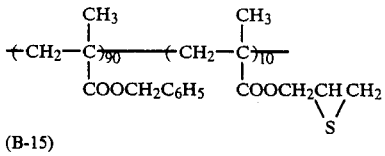 (B-15) | $\overline{M}w$ 41,000 | terephthalic acid | 1.5 g |
| 16 | A-21 | 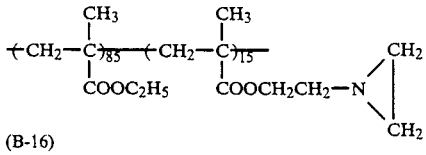 (B-16) | $\overline{M}w$ 35,000 | 1,4-tetra-methylenediamine | 1.2 g |
| 17 | A-32 | 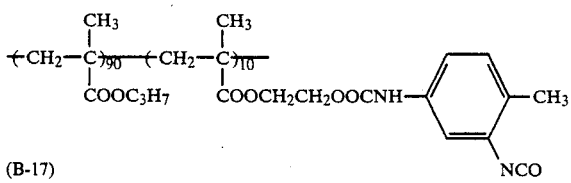 (B-17) | $\overline{M}w$ 37,000 | polyethylene glycol | 1.2 g |
| 18 | A-37 | (B-17) | | polypropylene glycol | 1.2 g |
| 19 | A-38 | 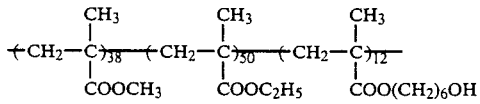 (B-18) | $\overline{M}w$ 42,000 | 1,6-hexamethyl-ene diisocyanate | 2 g |
| 20 | A-47 | 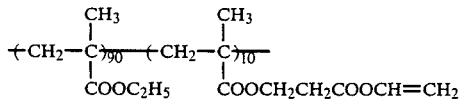 (B-19) | $\overline{M}w$ 55,000 | ethylene glycol dimethacrylate | 2 g |

The electrostatic characteristics and printing properties of each of the resulting photoreceptors was evaluated in the same manner as in Example 1. As a result, the photoreceptors of the present invention were proved to have excellent charging properties, dark decay retention, and photosensitivity and provided a clear reproduced image free from background fog or cut of thin lines even when processed under severe conditions of high temperature and high humidity (30° C., 80% RH). When they were used as an offset master plate precursor, the resulting printing plates provided more than 10000 prints having a clear image free from background stains in the non-image area.

EXAMPLES 21 TO 24

A mixture of 6.5 g each of resins (A) shown in Table 8 below, 20 g each of resins (B) of Group X shown in Table 8 below, 200 g of zinc oxide, 0.018 g of methine dye (C) shown below, 0.35 g of maleic anhydride, and 300 g of toluene was dispersed in a ball mill for 3 hours. To the dispersion was added 13.5 g each of resins (B) of Group Y shown in Table 8 below, followed by further dispersion in a ball mill for 10 minutes. The resulting photoconductive composition was coated on paper, rendered conductive, with a wire bar to a dry thickness of 20 g/m$^2$ and heated at 100° C. for 15 seconds and then at 120° C. for 2 hours. Then, the resulting coated material was allowed to stand at 20° C. and 65% RH for 24 hours to obtain an electrophotographic photoreceptor.

Methine Dye (C)

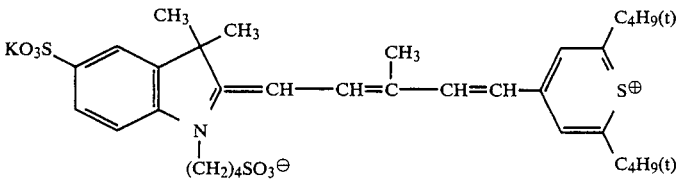

TABLE 8

| Example No. | Resin (A) | Resin (B)-X group | | Resin (B)-Y group | |
|---|---|---|---|---|---|
| 21 | (A-26) | 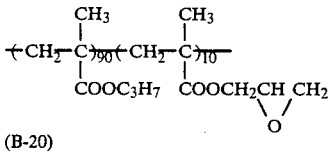 (B-20) | $\overline{M}w$ 42,000 | 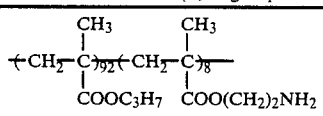 (B-21) | $\overline{M}w$ 38,000 |
| 22 | (A-28) | 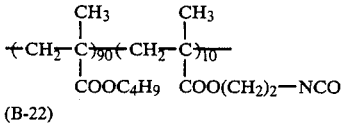 (B-22) | $\overline{M}w$ 45,000 | (B-21) | |
| 23 | (A-30) | 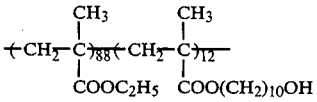 (B-23) | $\overline{M}w$ 38,000 | 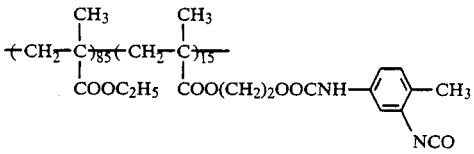 (B-24) | $\overline{M}w$ 46,000 |
| 24 | (A-37) | (B-21) | | 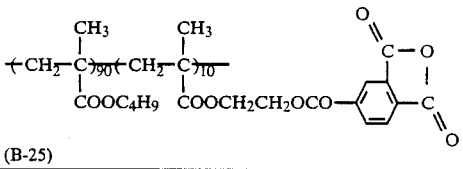 (B-25) | $\overline{M}w$ 33,000 |

As a result of evaluations in the same manner as in Example 1, each of the resulting photoreceptors according to the present invention was found to have excellent charging properties, dark charge retention, and photosensitivity, and provided a clear reproduced image free from background fog even when processed under severe conditions of high temperature and high humidity (30° C., 80% RH).

When an offset printing plate produced from each of the photoreceptors of the invention was used as an offset master for printing, more than 10000 prints of clear image could be obtained.

EXAMPLE 25

A mixture of 7 g of (A-27), 18 g of 9B-15), 200 g of zinc oxide 0.50 g of Rose Bengale, 0.25 g of Tetrabromophenol Blue, 0.30 g of uranine, 0.30 g of tetrahydrophthalic anhydride, and 240 g of toluene was dispersed in a ball mill for 2 hours. To the dispersion was further added 15 g of resin (B-26) shown below, followed by dispersion for 10 minutes. The resulting photosensitive composition was coated on paper, rendered conductive, with a wire bar to a dry thickness of 20 g/m$^2$, followed by drying at 110° C. for 30 seconds and then at 120° C. for 2 hours. The coating wa allowed to stand in a dark place at 20C. and 65% RH for 24 hours to prepare an electrophotographic photoreceptor.

Resin (B-26)

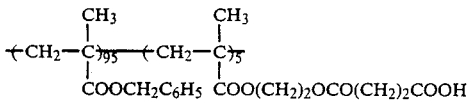

(Mw: 3.0 × 10$^4$)

The resulting photoreceptor was evaluated in the same manner as in Example 1 with the following exceptions. In the evaluation of electrostatic characteristics, DRR (%) was calculated from the formula ($V_{70}/V_{10} \times 100$), wherein $V_{20}$ and $V_{70}$ are surface potentials determined after standing for 10 seconds and standing or 70 seconds after the end of corona discharge, respectively. Photosensitive [$E_{1/20}$ (lux.sec)]was determined using visible light (2.0 lux) for exposure. In the evaluation of image forming performance, the sample as a printing plate precursor was processed form a toner image using an automatic plate making machine "ELP 404V" (manufactured by Fuji Photo Film Co., Ltd.) using "ELP-T" (produced by Fuji Photo Film Co., Ltd.) as a toner.

The results obtained were as follows.

Surface Smoothness: 120 cc/sec

Film Strength: 93%

Electrostatic Characteristics

| | $V_{10}$ (V) | DRR (%) | $E_{1/10}$ (lux.sec) |
|---|---|---|---|
| Condition I (20° C., 65% RH) | −675 | 95 | 7.8 |
| Condition II (30° C., 80% RH) | −670 | 93 | 8.3 |

Image Forming Performance

A satisfactory reproduced image was formed either under Condition I or under Condition II.

Printing durability: 10000 prints

It can thus be seen that the photoreceptor according to the present invention exhibits excellent electrophotographic characteristics and high printing durability.

EXAMPLES 26 AND 27

A mixture of 6 g each of (A-34) and (A-20), 34 g each of resins (B) shown in Table 9 below, 200 g of zinc oxide, 0.02 g of uranine, 0.04 g of Rose Bangale, 0.03 g of Bromophenol Blue, 0.40 g of phthalic anhydride, and 300 g of toluene was dispersed in a ball mill for 2 hours. The resulting composition was coated on paper, rendered conductive, with a wire bar to a dry thickness 20 g/m$^2$ and dried at 110° C. for 1 minute. The coating was then exposed to light emitted from a high-pressure mercury lamp for 3 minutes over the entire surface thereof and then allowed to stand in a dark, place at 20° C. and 65% RH for 24 hours to prepare an electrophotographic photoreceptor. The characteristics of the resulting photoreceptors are shown in Table 10 below.

TABLE 9

| Example No. | Resin (A) | Resin (B) |
|---|---|---|
| 26 | (A-34) | (B-27): 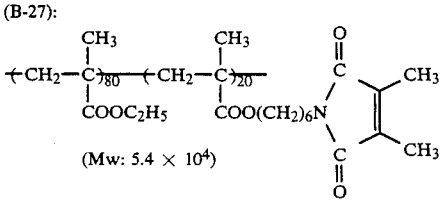 (Mw: 5.4 × 10$^4$) |
| 27 | (A-20) | (B-28): 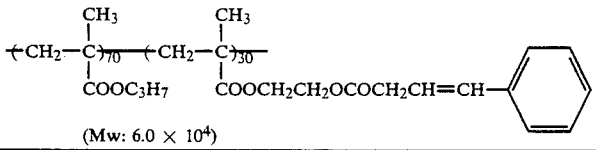 (Mw: 6.0 × 10$^4$) |

TABLE 10

| Example No. | Surface Smoothness (cc/sec) | Film Strength (%) | $V_{10}$ (−V) | DRR (%) | $E_{1/10}$ (lux.sec) | Printing Durability |
|---|---|---|---|---|---|---|
| 26 | 130 | 95 | 650 | 88 | 9.8 | 9000 |
| 27 | 135 | 94 | 555 | 88 | 9.6 | 8500 |

As is shown by the results in Table 10, the photoreceptors according to the present invention had excellent charging properties, dark decay retention and photosensitivity and provided a clear reproduced image free from background fog even when processed under severe conditions of high temperature and high humidity (30° C., 80% RH). When they were used as an offset master plate precursor, the resulting master plate provided 8500 to 9000 prints of clear image.

While the invention has been described in detail and with reference to specific embodiments thereof, it will be apparent to one skilled in the art that various changes and modifications can be made therein without departing from the spirit and scope thereof.

What is claimed is:

1. An electrophotographic photoreceptor comprising a support having thereon at least one photoconductive layer containing at least inorganic photoconductive particles and a binder resin, wherein said binder resin has a weight average molecular weight of from $1\times10^3$ to $5\times10^4$ and comprises (A) at least one resin comprising, as a polymerization component, (a-i) not less than 30% by weight of at least one repeating unit represented by formula (I) or (II):

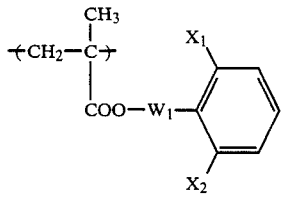

(I)

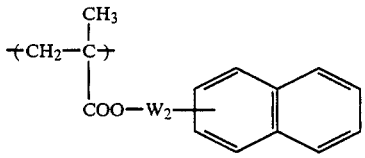

(II)

wherein $X_1$ and $X_2$, which may be the same or different, each represents a hydrogen atom, a hydrocarbon group having form 1 to 10 carbon atoms, a chlorine atom, a bromine atom, —$COY_1$ or —$COOY_2$, wherein $Y_1$ and $Y_2$ each represents a hydrocarbon group having from 1 to 10 carbon atoms, provided that both $X_1$ and $X_2$ do not simultaneously represent a hydrogen atom; and $W_1$ and $W_2$ each represents a bond or a linking group containing from 1 to 4 linking atoms which connects —COO— and the benzene ring, with at least one acidic group selected from the group consisting of (i) —$PO_3H_2$, (ii) —$SO_3H$, (iii) —COOH,

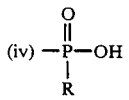

wherein R represents a hydrocarbon group having from 1 to 10 carbon atoms or —OR', wherein R' represents a hydrocarbon group having from 1 to 10 carbon atoms, and (v) a cyclic acid anhydride-containing group, being bonded to only one of the terminals of the polymer main chain thereof.

2. An electrophotographic photoreceptor as claimed in claim 1, wherein said resin (A) further comprises (a-ii) from 1 to 20% by weight of at least one repeating unit containing a heat- and/or light-curing functional group.

3. An electrophotographic photoreceptor as claimed in claim 1, wherein said binder resin further comprises (B) at least one resin having a weight average molecular weight of from $2\times10^4$ to $6\times10^5$.

4. An electrophotographic photoreceptor as claimed in claim 3, wherein said resin (B) comprises (b-i) at least 30% by weight of a repeating unit represented by formula (III):

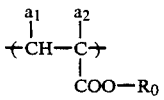

(III)

wherein $a_1$ and $a_2$, which may be the same or different, each represents a hydrogen atom, a halogen atom, a cyano group or a hydrocarbon group; and $R_0$ represents a hydrocarbon group.

5. An electrophotographic photoreceptor as claimed in claim 4, wherein said resin (B) further comprises form 0.05 to 5% by weight of a copolymerization component containing at least one acidic group selected from the group consisting of (i) $—PO_3H_2$, (ii) $—SO_3H$, (iii) —COOH,

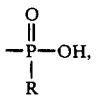

(iv)

wherein R represents a hydrocarbon group having from 1 to 10 carbon atoms or —OR', wherein R' represents a hydrocarbon group having from 1 to 10 carbon atoms, and (v) a cyclic acid anhydride-containing group, said resin (B) having a weight average molecular weight of from $2\times10^4$ to $1\times10^5$.

6. An electrophotographic photoreceptor as claimed in claim 3, wherein said resin (B) comprises from 1 to 30% by weight of at least one repeating unit containing a heat- and/or light-curing functional group.

7. An electrophotographic photoreceptor as claimed in claim 1, wherein said photoconductive layer further contains a heat- and/or light-curing crosslinking agent.

8. An electrophotographic photoreceptor as claimed in claim 1, wherein $X_1$ and $X_2$ each represents a hydrogen atom, a chlorine atom, a bromine atom, an alkyl group having up to 4 carbon atoms, an aralkyl group having from 7 to 9 carbon atoms, an aryl group or $—COY_1$ or $—COOY_2$, wherein $Y_1$ and $Y_2$ each represents the groups as described for $X_1$ and $X_2$, except that $X_1$ and $X_2$ do not simultaneously represent a hydrogen atom; $W_1$ is a bond or a linking group containing 1 to 4 linking atoms and $W_2$ has the same meaning as $W_1$.

9. An electrophotographic photoreceptor as claimed in claim 1, wherein the hydrocarbon group represented by R or R' is an aliphatic group having from 1 to 10 carbon atoms, or an aryl group.

10. An electrophotographic photoreceptor as claimed in claim 1, wherein the acid anhydride containing group is an aliphatic dicarboxylic acid anhydride ring or an aromatic dicarboxylic acid anhydride ring.

11. An electrophotographic photoreceptor as claimed in claim 10, wherein said aliphatic dicarboxylic acid anhydride ring is a succinic anhydride ring, a glutaconic anhydride ring, a maleic anhydride ring, a cyclopentane-1,2-dicarboxylic acid anhydride ring, a cyclohexane-1,2-dicarboxylic acid anhydride ring, a cyclohexene-1,2-dicarboxylic acid anhydride ring or a 2,3-bicyclo[2,2,2]octanedicarboxylic acid anhydride ring, which rings may be unsubstituted or substituted with at least one of a halogen atom and an alkyl group and said aromatic dicarboxylic acid anhydride ring is a phthalic anhydride ring, a naphthalene-dicarboxylic acid anhydride ring, a pyridine-dicarboxylic acid anhydride ring or a thiophene-dicarboxylic acid anhydride ring, which may be unsubstituted or substituted with at least one of a halogen atom, an alkyl group, a hydroxyl group, a cyano group, a nitro group and an alkoxycarbonyl group.

* * * * *